US008579278B2

(12) United States Patent
Arikata et al.

(10) Patent No.: US 8,579,278 B2
(45) Date of Patent: Nov. 12, 2013

(54) PAPER SHEET HANDLING APPARATUS WITH FIRST AND SECOND TRANSPORT SURFACES

(75) Inventors: Jun Arikata, Hyogo (JP); Michio Yamamoto, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 0 days.

(21) Appl. No.: 13/443,010

(22) Filed: Apr. 10, 2012

(65) Prior Publication Data

US 2012/0261874 A1 Oct. 18, 2012

(30) Foreign Application Priority Data

Apr. 18, 2011 (JP) ..... 2011-092345

(51) Int. Cl.
*B65H 1/22* (2006.01)

(52) U.S. Cl.
USPC ..... 271/162; 271/9.12

(58) Field of Classification Search
USPC ..... 271/3.01, 9.01, 9.11, 279, 292, 298, 271/164, 273, 274; 209/534; 902/15
See application file for complete search history.

(56) References Cited

U.S. PATENT DOCUMENTS 5,765,825 A * 6/1998 Watase ..... 271/9.13
6,290,070 B1 * 9/2001 Graef et al. ..... 209/534
7,404,552 B2 * 7/2008 Abe et al. ..... 271/3.14
2002/0036159 A1 * 3/2002 Graef et al. ..... 209/534
2004/0178559 A1 9/2004 Harty et al.
2006/0169623 A1 * 8/2006 Razzaboni et al. ..... 209/534
2007/0023988 A1 * 2/2007 Abe et al. ..... 271/3.01
2010/0052237 A1 * 3/2010 Herczeg et al. ..... 271/3.16
2010/0303529 A1 * 12/2010 Shiba ..... 399/388
2011/0233855 A1 9/2011 Herczeg et al.

FOREIGN PATENT DOCUMENTS

EP 0 795 842 A2 9/1997
JP 63-242839 10/1988

OTHER PUBLICATIONS

European Extended Search Report (Application No. 12164421.5-1229) (5 pages—dated Jun. 22, 2012).

* cited by examiner

*Primary Examiner* — Jeremy R Severson
(74) *Attorney, Agent, or Firm* — Renner, Kenner, Greive, Babak, Taylor & Weber

(57) ABSTRACT

A paper sheet handling apparatus includes: a transport path including a pair of a first transport surface and a second transport surface; at least one storage module configured to store the paper sheets transported through the transport path; and a body including the transport path and the storage module. The storage module is attachable and detachable to and from the body by moving the storage module in a predetermined direction, a part of an outer surface of the storage module attached to the body forms the first transport surface, and the second transport surface is exposed when the storage module is detached from the body so that the second transport surface is visible from the predetermined direction.

4 Claims, 19 Drawing Sheets

| | DENOMINATION | BLOCK NUMBER |
|---|---|---|
| ⋮ | ⋮ | ⋮ |
| 5 | 10 EURO | 1 |
| 6 | 10 EURO | 1 |
| 7 | 10 EURO | 2 |
| 8 | 10 EURO | 2 |
| 9 | 10 EURO | 2 |
| 10 | 10 EURO | 3 |
| 11 | 10 EURO | 3 |
| 12 | 10 EURO | 3 |
| 13 | 10 EURO | 3 |
| ⋮ | ⋮ | ⋮ |

PAPER SHEET HANDLING APPARATUS WITH FIRST AND SECOND TRANSPORT SURFACES

CROSS-REFERENCE TO RELATED APPLICATION

This application claims priority to Japanese Patent Application No. 2011-92345 filed on Apr. 18, 2011, the disclosure of which including the specification, the drawings, and the claims is hereby incorporated by reference in its entirety.

BACKGROUND

The present disclosure relates to a paper sheet handling apparatus configured to handle banknotes and other paper sheets.

Japanese Patent Publication No. S63-2428391 discloses a machine for depositing and dispensing banknotes installed in an automatic teller machine. The banknote depositing/dispensing machine includes first to third cassettes. Each of the cassettes stores banknotes introduced in the banknote depositing/dispensing machine, and the three cassettes are aligned in a front-back direction in a lower unit of the banknote depositing/dispensing machine. The banknotes placed in an inlet are transported through a transport path provided in the inside of the machine, and are sent to the cassettes. Part of the transport path is formed by upper surfaces of the cassettes and a transport path unit extending in the front-back direction above the three cassettes. The banknotes are sandwiched between the upper surfaces of the cassettes (the upper surface may be referred to as a transport surface), and a lower surface of the transport path unit (i.e., a transport surface).

International Patent Publication No. WO2008/047094 discloses a banknote depositing/dispensing machine which is placed in a teller counter of a financial institution, such as a bank, and is operated by a teller at a teller window. The depositing/dispensing machine includes 6 storage units for storing the banknotes. Rows of 3 storage units arranged in the front-back direction are stacked in a vertical direction, i.e., three pairs of vertically stacked storage units are arranged in the front-back direction. In the depositing/dispensing machine, a transport path is formed between the upper row of the storage units and the lower row of the storage units. More specifically, lower surfaces of the storage units in the upper row constitute an upper transport surface, and upper surfaces of the storage units in the lower row constitute a lower transport surface.

SUMMARY

In the paper sheet handling apparatuses including the banknote depositing/dispensing machines described in the above-mentioned patent documents, the paper sheet may be jammed during the transport. In this case, the apparatus is opened to remove the jammed paper sheet from the transport path by hand.

According to the banknote depositing/dispensing machine of Japanese Patent Publication No. S63-2428391, a rear end of the transport path unit extending in the front-back direction is connected to the lower unit so that the transport path unit is rotatable in an upward direction. Specifically, when the banknote is jammed in this banknote depositing/dispensing machine, the lower unit is pulled out of the casing, and the transport path unit is rotated about a rear end axis to expose the transport path formed between the transport path unit and the cassettes, thereby removing the jammed banknote.

However, when the transport path unit is rotatably supported, and the angle of rotation is constant, part of the transport path farther from the axis is exposed relatively wide to allow easy removal of the banknote, while part of the transport path closer to the axis is not widely exposed as shown in FIG. 4 of Japanese Patent Publication No. S63-2428391. Thus, the banknote jammed in this part cannot be easily removed.

According to the banknote depositing/dispensing machine of International Patent Publication No. WO 2008/047094, a pair of vertically stacked storage units are connected with a hinge attached to left sides of the storage units. More specifically, a lower left end of the upper storage unit and an upper left end of the lower storage unit are connected with the hinge. Thus, the upper storage unit is rotatable to the left relative to the lower storage unit. When the banknote is jammed in this banknote depositing/dispensing machine, the 6 storage units are pulled forward out of the casing, and then the upper storage units are rotated to the left to expose the transport path formed between the upper and lower storage units, thereby removing the banknote.

However, like the banknote depositing/dispensing machine of Japanese Patent Publication No. S63-2428391, when the storage units are connected with the hinge, and the angle of rotation is constant, the banknote jammed in part of the transport path closer to the hinge cannot easily be removed. In the banknote depositing/dispensing machine of International Patent Publication No. WO 2008/047094, the upper storage units are rotated. The storage units are relatively tall because they contain the banknotes. When the upper storage units are rotated to the left about the lower left ends thereof, upper left ends of the upper storage units significantly move to the left of the machine. Thus, for example, when the banknote depositing/dispensing machine is placed with its left side adjacent to a wall, the upper storage units strike the wall. Thus, the upper storage units cannot greatly be rotated, thereby making the removal of the jammed banknote difficult.

Further, in order to rotate the storage units to the left, an operator needs to lift the upper storage units from the right of the machine, i.e., the side opposite the hinge-connected side. However, depending on the location of the banknote depositing/dispensing machine, the working space for the operator cannot easily be ensured, and workability in removing the jammed banknote may decrease.

In view of the foregoing, the disclosed technology has been achieved. The disclosed technology is concerned with providing the paper sheet handling apparatus which allows easy removal of the jammed paper sheet.

The disclosed apparatus is a paper sheet handling apparatus configured to handle paper sheets. The paper sheet handling apparatus includes: a transport path which includes a pair of a first transport surface and a second transport surface facing each other, and is configured to transport the paper sheets between the first and second transport surfaces; at least one storage module configured to store the paper sheets transported through the transport path; and a body including the transport path and the storage module.

The storage module is attachable and detachable to and from the body by moving the storage module in a predetermined direction, a part of an outer surface of the storage module attached to the body forms the first transport surface, and the second transport surface is exposed when the storage module is detached from the body so that the second transport surface is visible from the predetermined direction.

The "storage module" includes a module configured to store the paper sheets transported through the transport path, a module configured to feed the stored paper sheets to transport them through the transport path, and a module configured to store and feed the paper sheets.

The "detached" storage module designates the storage module separated from the body. For example, the storage module connected to the body with, e.g., a hinge, is not the "detached" storage module. However, suppose that the storage module and the body are coupled with a string-like member, such as a chain, the storage module detached and separated from the body with the storage module kept coupled to the body with the string-like member is included in the "detached" storage module. A locking mechanism for locking or unlocking the storage module and the body may be provided between the storage module and the body. In this case, when the locking mechanism locks the storage module and the body, the storage module and the body are not separable. However, when the locking mechanism unlocks the storage module and the body, the storage module and the body can be separated.

In this configuration, the first transport surface is formed by a part of the outer surface of the storage module attached to the body. The paper sheets are transported through the transport path formed by the first transport surface and the second transport surface.

When the paper sheet is jammed in the paper sheet handling apparatus, the storage module is detached from the body. Thus, the second transport surface of the transport path is exposed. The storage module is detached from the body by moving the storage module in the predetermined direction, and is separated from the body. For example, when the storage module and the body are connected to each other, e.g., with a hinge, the movement of the storage module is restricted by the connection. Specifically, when the hinge is used, the storage module is merely rotated about a hinge axis. Thus, space is required in a certain area around the paper sheet handling apparatus (e.g., an area to which the storage module is rotated) to allow the movement of the storage module.

In contrast, the disclosed configuration in which the storage module is separable from the body, the restriction by the space is eliminated. Thus, irrespective of the location of the space around the paper sheet handling apparatus, the storage module can easily be detached from the body. Since the storage module is separated from the body, the transport path, or the second transport surface, can widely be exposed to be visible in the predetermined direction. Specifically, when the storage module is configured to be movable upward, the second transport surface is exposed to be visible from above. When the storage module is configured to be movable forward, the second transport surface is exposed to be visible from the front. This allows easy removal of the jammed paper sheet.

The storage module may include at least a first storage module and a second storage module, the first storage module and the second storage module may be attached to the body to be adjacent to each other in such a manner that the first storage module is located outward with respect to the second storage module in the predetermined direction, a part of an outer surface of the first storage module may form the first transport surface, a part of an outer surface of the second storage module may form the second transport surface, the first storage module may be attachable and detachable to and from the body, and the second transport surface formed by the second storage module may be exposed to be visible when the first storage module is detached from the body.

The "first storage module is attachable and detachable to and from the body" includes the case where the first storage module can directly be attachable and detachable to and from the body, and the case where the first storage module can be attachable and detachable to and from the second storage module attached to the body so that the first storage module can indirectly be attachable and detachable to and from the body. A locking mechanism may be provided between the first storage module and the second storage module.

In this configuration, when the paper sheet is jammed, the first storage module attached outward with respect to the second storage module in the predetermined direction is detached from the body as described above, thereby separating the first storage module from the body, and widely exposing the second transport surface formed by the second storage module. Thus, a combination of the easy removal of the first storage module and the wide exposure of the second transport surface allows easy removal of the jammed paper sheet.

The first and second storage modules may be able to be coupled to each other, and the first and second storage modules coupled to each other may be detachable together from the body.

The transport path may transport the paper sheets in a transport direction substantially parallel to a horizontal direction, and the predetermined direction in which the storage module is attached or detached may substantially be perpendicular to the transport direction.

This configuration allows easy removal of the paper sheet from the paper sheet handling apparatus in which the storage module is pulled out of the body in the horizontal direction, and the pulled storage module is detached by moving the storage module upward. In particular, even when sufficient space cannot be provided on the right and left sides of the paper sheet handling apparatus, the storage module can easily be detached by moving the storage module upward, and the second transport surface can be exposed upward. This allows easy removal of the paper sheet.

As described above, the disclosed paper sheet handling apparatus allows easy removal of the jammed paper sheet.

DETAILED DESCRIPTION

Figure 1:
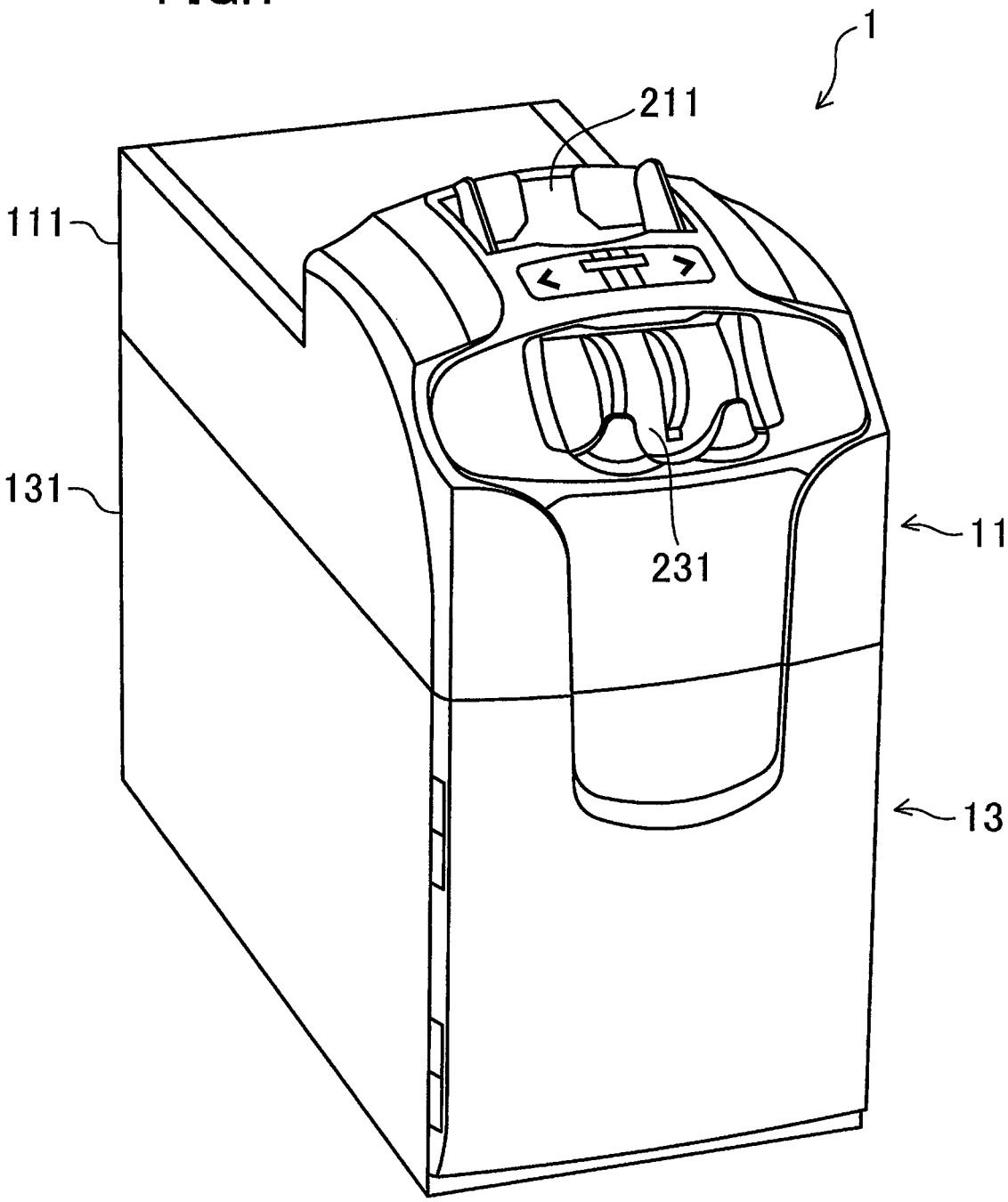
FIG. 1 is a perspective view of an appearance of a banknote depositing/dispensing machine.

An embodiment of a banknote depositing/dispensing machine will be described with reference to the drawings. The following preferred embodiment will be described merely as an example. FIG. 1 shows an appearance of a banknote depositing/dispensing machine (hereinafter merely referred to as a depositing/dispensing machine) 1. The depositing/dispensing machine 1 is placed in a teller counter of a bank, for example, and is shared by two tellers on the right and left sides of the depositing/dispensing machine 1. Thus, the depositing/dispensing machine 1 is basically bilaterally symmetrical.

As described in detail later, the depositing/dispensing machine 1 at least performs a depositing process for storing banknotes placed in an inlet 211 in a storage unit 3, and a dispensing process for dispensing the banknotes stored in the storage unit 3 to an outlet 231. The depositing/dispensing machine 1 is a so-called circulating depositing/dispensing machine. The banknotes dispensed in the dispensing process include the banknotes stored in the storage unit 3 in the depositing process.

Figure 2:
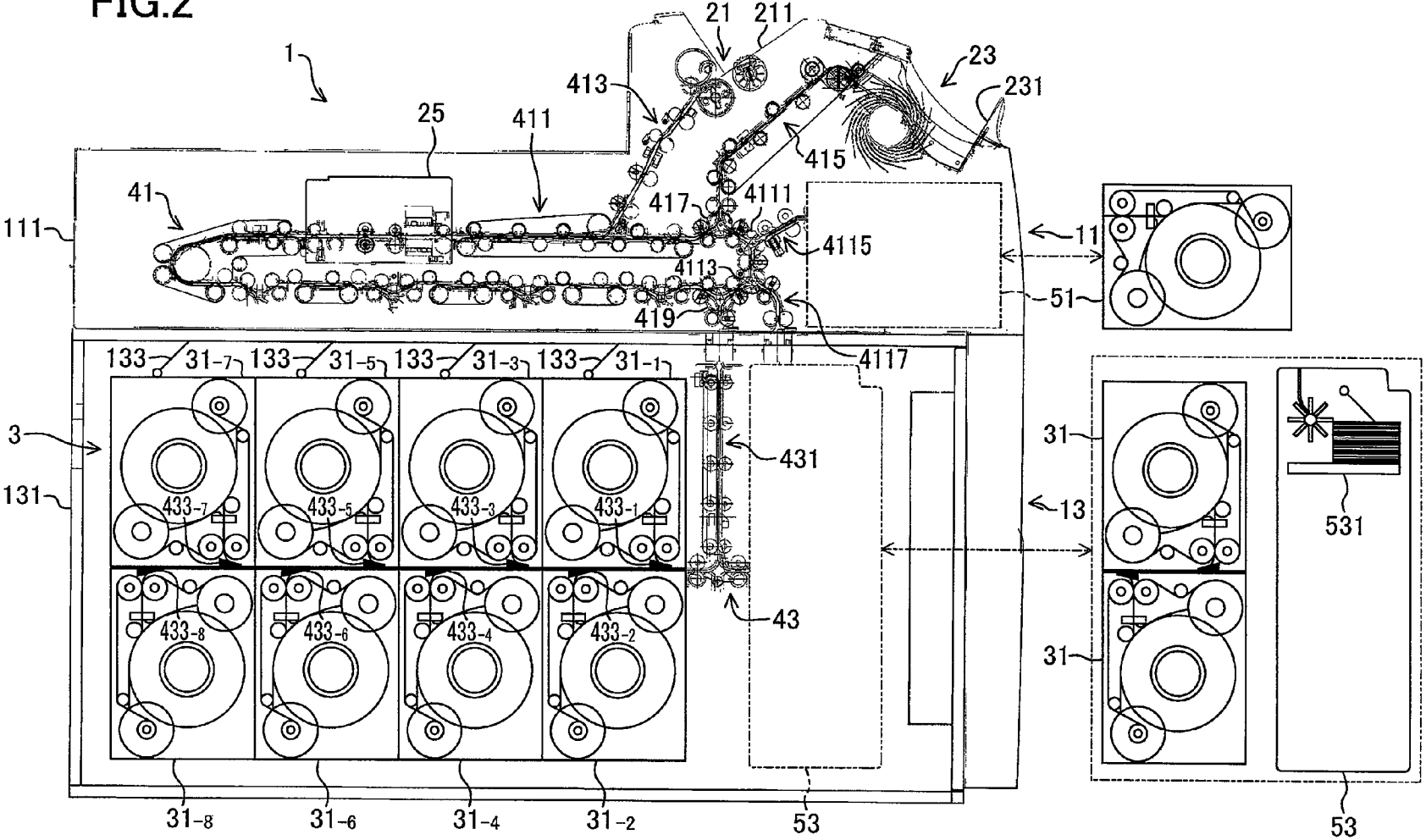
FIG. 2 shows an internal structure of the banknote depositing/dispensing machine.

As shown in FIGS. 1 and 2, the depositing/dispensing machine 1 is broadly divided into an upper handling unit 11 and a lower safe unit 13. A casing 111 constituting the handling unit 11 contains a depositing unit 21 having the inlet 211, a dispensing unit 23 having the outlet 231, a recognition unit 25 configured to recognize the banknotes, and an upper transport unit 41 which includes a looped transport path 411 connecting the depositing unit 21, the dispensing unit 23, and the recognition unit 25. A casing 131 constituting the safe unit 13 contains a storage unit 3 including a plurality of winding storage modules 31 (8 storage modules in the example shown in the figures), and a lower transport unit 43 including a transport path 431 connecting the looped transport path 411 of the upper transport unit 41 and the storage modules 31. Unlike the casing 111 constituting the handling unit 11, the casing 131 constituting the safe unit 13 is a protective casing 131 configured to protect the storage unit 3 etc. contained therein at a predetermined security level or higher.

As described above, the inlet 211 of the depositing unit 21 is a port in which the banknotes to be deposited are placed in the depositing process. The inlet 211 is opened upward in an upper surface of the casing 111, and can receive a plurality of banknotes at a time. The depositing unit 21 includes a feeding mechanism for feeding the plurality of banknotes placed in the inlet 211 one by one to the looped transport path 411.

As described above, the outlet 231 of the dispensing unit 23 is a port to which the banknotes are dispensed in the dispensing process. The outlet 231 is located forward of the inlet 211 (on the right of the inlet in FIG. 2), and is opened obliquely upward between the upper surface and a front surface of the casing 111. Like the inlet 211, the outlet 231 is capable of receiving a plurality of banknotes at a time.

The recognition unit 25 is provided on the looped transport path 411 to recognize authenticity, fitness, and denomination of each of the banknotes transported on the looped transport path 411.

The upper transport unit 41 includes the looped transport path 411 endlessly running in the casing 111. The banknotes are transported on the looped transport path 411 clockwise and counterclockwise in FIG. 2. The looped transport path 411 includes a combination of a plurality of rollers, belts, and guides as shown in FIG. 2. The looped transport path 411 allows long edge feed of the banknotes one by one with a predetermined gap kept between the banknotes.

The looped transport path 411 and the inlet 211 are connected through a depositing path 413, and the banknotes placed in the inlet 211 are transported to the looped transport path 411 through the depositing path 413.

A dispensing path 415 is connected to the looped transport path 411 through a diverter 417 for changing the traveling direction of the banknotes. An end of the dispensing path 415 is connected to the outlet 231. The diverter 417 is configured to keep the banknotes traveling on the looped transport path 411 clockwise or counterclockwise, or to introduce the banknotes to the dispensing path 415. Thus, the banknotes traveling on the looped transport path 411 clockwise or counterclockwise are selectively transported to the outlet 231 by the diverter 417 through the dispensing path 415.

First to third diverters 419, 4111, 4113 are provided on the looped transport path 411. Each of the first to third diverters 419-4113 is positioned at a junction of three transport paths extending in different directions, and selectively transports the banknotes traveling from one of the transport paths to the other two transport paths. Details of the diverters are described in International Patent Publication WO2009/034758 which is herein incorporated by reference.

Specifically, the first diverter 419 is provided at a junction between the looped transport path 411 and the transport path 431 of the lower transport unit 43. The first diverter 419 selectively sends the banknotes traveling on the looped transport path 411 clockwise or counterclockwise to the transport path 431 of the lower transport unit 43 to store the banknotes in the storage unit 3, or allows the banknotes fed from the storage unit 3, and traveling on the transport path 431 of the lower transport unit 43 to travel clockwise or counterclockwise on the looped transport path 411.

The second diverter 4111 is provided at a junction between the looped transport path 411 and a connection path 4115. As described in detail later, the connection path 4115 connects an escrow unit 51 which is shown in a phantom line in FIG. 2 and the looped transport path 411. The second diverter 4111 sends the banknotes traveling on the looped transport path 411 clockwise or counterclockwise to the connection path 4115 to store the banknotes in the escrow unit 51, or transports the banknotes fed from the escrow unit 51 clockwise or counterclockwise on the looped transport path 411.

The third diverter 4113 is provided at a junction between the looped transport path 411 and a cassette connection path 4117. As described in detail later, the cassette connection path 4117 connects a collection cassette 53 which is shown in a phantom line in FIG. 2 and the looped transport path 411. The third diverter 4113 selectively sends the banknotes traveling on the looped transport path 411 clockwise or counterclockwise to the cassette connection path 4117 to store the banknotes in the collection cassette 53.

As described above, the storage unit 3 includes first to eighth winding (or tape-type) storage modules $\mathbf{31}_{-1}$ to $\mathbf{31}_{-8}$. In the following description, a set of the eight storage modules will be indicated by a reference character "31," while the first, second, third, . . . storage modules will be indicated by reference characters "$\mathbf{31}_{-1}$, $\mathbf{31}_{-2}$, $\mathbf{31}_{-3}$, . . . " The number of the storage modules 31 is not particularly limited as long as more than one storage module 31 is provided. In this example, two rows of four storage modules 31 arranged in a depth direction of the machine (right-left direction in FIG. 2) are vertically stacked.

The winding storage module 31 includes a tape for guiding the banknotes, a guide, a reel for winding the tape and the banknotes, and a substantially rectangular casing containing the tape, the guide, and the reel as described in Japanese Patent Publication No. 2000-123219. Alternatively, the winding storage module 31 includes two tapes for sandwiching the banknotes, a reel for winding the two tapes sandwiching the banknotes, and a casing containing the tapes and the reel as described in International Patent Publication No. WO2011/036782 which is herein incorporated by reference. In either structure, the winding storage module 31 winds the banknotes one by one to store them, and feeds the banknotes one by one in a reverse order of the storing order, i.e., the last stored banknote is first fed. In the example shown in FIG. 2, each of the storage modules 31 includes two tape reels 313 around each of which a tape is wound, and the banknotes are sandwiched between the two tapes extending from the tape reels 313. The banknotes are wound around the reel 311 with predetermined gaps provided therebetween. Each of the storage modules 31 is provided with a sensor arranged near an opening communicating the inside and the outside of the casing to detect the passage of the banknotes.

Like the looped transport path 411 of the upper transport unit 41, the transport path 431 of the lower transport unit 43 includes a combination of a plurality of rollers, belts, and guides, and the transport path 431 allows long edge feed of the banknotes one by one. The transport path 431 extends vertically downward from the first diverter 419 on the looped transport path 411, and a lower end thereof is branched forward (to the right in FIG. 2) and rearward (to the left in FIG. 2) in a depth direction of the machine 1. The branch path extending rearward of the machine 1 is arranged between the two vertically stacked rows of the storage modules 31. The storage modules 31 are connected to the branch path through sorters $\mathbf{433}_{-1}$ to $\mathbf{433}_{-8}$, respectively. Each of the sorters $\mathbf{433}_{-1}$ to $\mathbf{433}_{-8}$ is controlled by a control unit 513 described later to sort the banknotes by the denomination and/or the fitness recognized by the recognition unit 25, and to store the sorted banknotes in the plurality of storage modules 31.

To the depositing/dispensing machine 1, the escrow unit 51 for temporarily retaining the banknotes, and the collection cassette 53 detachably provided in the protective casing 131 of the safe unit 13 can optionally be attached.

The escrow unit 51 is placed in empty space in the casing 111 forward of the looped transport path in the depth direction as shown in a phantom line in FIG. 2. The escrow unit 51 is connected to the second diverter 4111 through the connection path 4115 as described above. In this example, the escrow unit 51 is a winding unit including two tapes, and stores the banknotes without changing the order of the banknotes so that the last stored banknote is first fed, like the storage modules 31 described above.

The collection cassette 53 is detachably placed in empty space in the protective casing 131 forward of the storage modules in the depth direction as shown in a phantom line in FIG. 2. The collection cassette 53 is connected to the third diverter 4113 on the looped transport path 411 through the cassette connection path 4117 as described above. Unlike the winding storage modules 31 and the escrow unit 51, the collection cassette 53 contains an ascending/descending table therein to store the banknotes stacked thereon. Thus, the banknotes stored in the collection cassette 53 cannot be fed out of the cassette. For example, the collection cassette 53 stores some of the banknotes placed in the inlet 211 in the depositing process, but not stored in the storage unit 3, i.e., overflowed banknotes. The banknotes which were unrecognizable and rejected in the dispensing process etc. may also be stored in the collection cassette 53. When the collection cassette 53 is not attached, the overflowed or rejected banknotes are dispensed to the outlet 231. The collection cassette 53 is not always box-shaped as shown in FIG. 2, but may be bag-shaped.

Additional winding storage modules 31 may be placed in the empty space in the protective casing 131 in place of the collection cassette 53. For example, two additional storage modules 31 may vertically be stacked in the empty space as shown in FIG. 2. Each of the two storage modules 31 is connected to the branch path extending from the lower end of the transport path 431 forward in the depth direction of the machine through the sorter described above.

Figure 3:
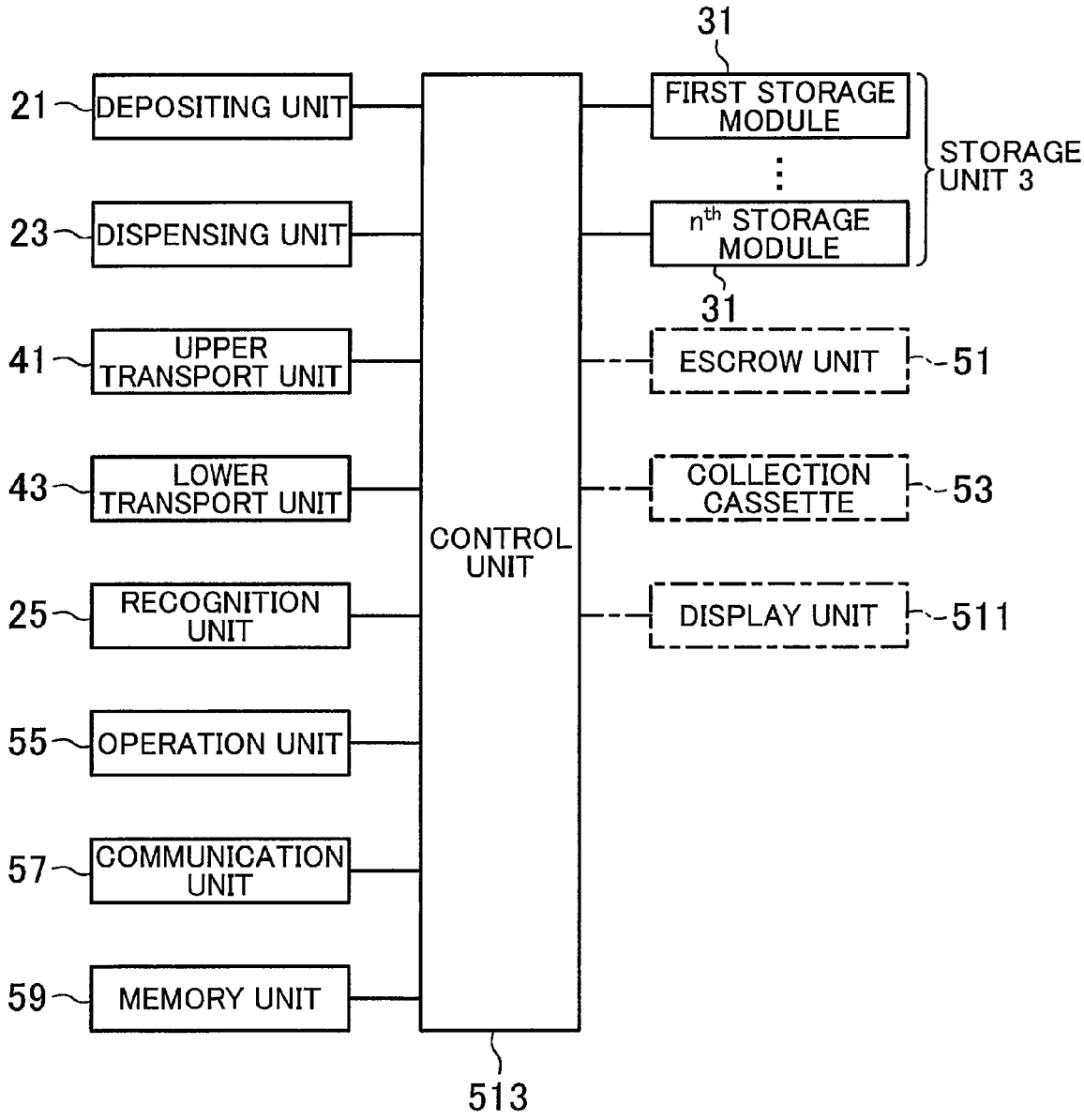
FIG. 3 is a block diagram of a structure associated with control of the banknote depositing/dispensing machine.

FIG. 3 shows a structure associated with control of the depositing/dispensing machine 1. The depositing/dispensing machine 1 includes a control unit 513 which may basically be comprised of a well-known microcomputer. The control unit 513 is connected to the depositing unit 21, the dispensing unit 23, the storage unit 3 including the first to the $n^{th}$ storage modules 31, the upper transport unit 41, and the lower transport unit 43 so that signals can be sent and received therebetween. Although not shown, each of the units 21, 23, 3, 41, and 43 includes a sensor for detecting the banknotes traveling on the transport path, for example, and detection signals from the sensors are input to the control unit 513. The control unit 513 outputs control signals based on the input detection signals, and the units 21, 23, 3, 41, and 43 are operated in accordance with the signals.

The control unit 513 is also connected to the recognition unit 25. The recognition unit 25 sends the recognition result to the control unit 513. Although not shown in FIG. 1 etc., the depositing/dispensing machine 1 is also connected to an operation unit 55 as a human interface for an operator of the depositing/dispensing machine 1, such as a teller, a communication unit 57 for sending and receiving signals between the depositing/dispensing machine 1 and a higher-ranking machine and other devices (not shown) through LAN or a serial bus, and a memory unit 59 for storing various types of information, e.g., general-purpose storage devices such as a hard disk drive, a flash memory.

The memory unit 59 stores at least an inventory amount which is the respective numbers of the banknotes of different denominations or the amount of the banknotes stored in the depositing/dispensing machine 1. The memory unit 59 stores the inventory amount of each storage module 31.

As described above, when the optional escrow unit 51 and collection cassette 53 are attached to the depositing/dispensing machine 1, the escrow unit 51 and the collection cassette 53 are also connected to the control unit 513, and are operated by the control signals output from the control unit 513. The depositing/dispensing machine 1 may optionally be provided with a display unit 511, such as a flat panel display, for displaying various types of information. The display unit 511 is also connected to the control unit 513.

The control unit 513 controls the units 21, 23, 25, 3, 41, 43, 51, 53, 55, 57, 59, and 511 according to a command sent from the higher-ranking machine through the communication unit 57, and/or various commands sent through the operation unit 55. Thus, the depositing/dispensing machine 1 performs various processes including the depositing and dispensing processes described below. The processes performed by the depositing/dispensing machine 1 are stored as a log in the memory unit 59.

(Depositing Process)

The depositing process is a process for depositing (storing) the banknotes in the depositing/dispensing machine 1. Each of the banknotes placed in the inlet 211 is stored in any of the storage modules 31 based on the results of the recognition by the recognition unit 25, and the predetermined types (denomination, fitness, etc.) of the banknotes allocated to the storage modules 31. More specifically, the depositing/dispensing machine 1 performs the depositing process in the following manner. When the banknotes are placed in the inlet 211, a command to start the depositing process is input to the depositing/dispensing machine 1 by operating the higher-ranking machine and/or the operation unit 55. As indicated by arrows in FIG. 4, the feeding mechanism of the depositing unit 21 feeds the banknotes in the inlet 211 one by one, and the upper transport unit 41 transports the banknotes to the recognition unit 25. The recognition unit 25 recognizes and counts the banknotes. The upper transport unit 41 transports the banknotes recognized as acceptable by the recognition unit 25 (the acceptable banknotes will be referred to as normal banknotes in contrast with the rejected banknotes) from the looped transport path 411 to the transport path 431 of the lower transport unit 43 through the first diverter 419 as indicated by solid arrows in FIG. 4. The lower transport unit 43 stores each of the banknotes in the predetermined storage module 31 based on the results of the recognition by the recognition unit 25, and the predetermined types of the banknotes allocated to the storage modules. Specifically, each of the banknotes is stored in the corresponding storage module 31 based on the denomination or fitness.

Figure 4:
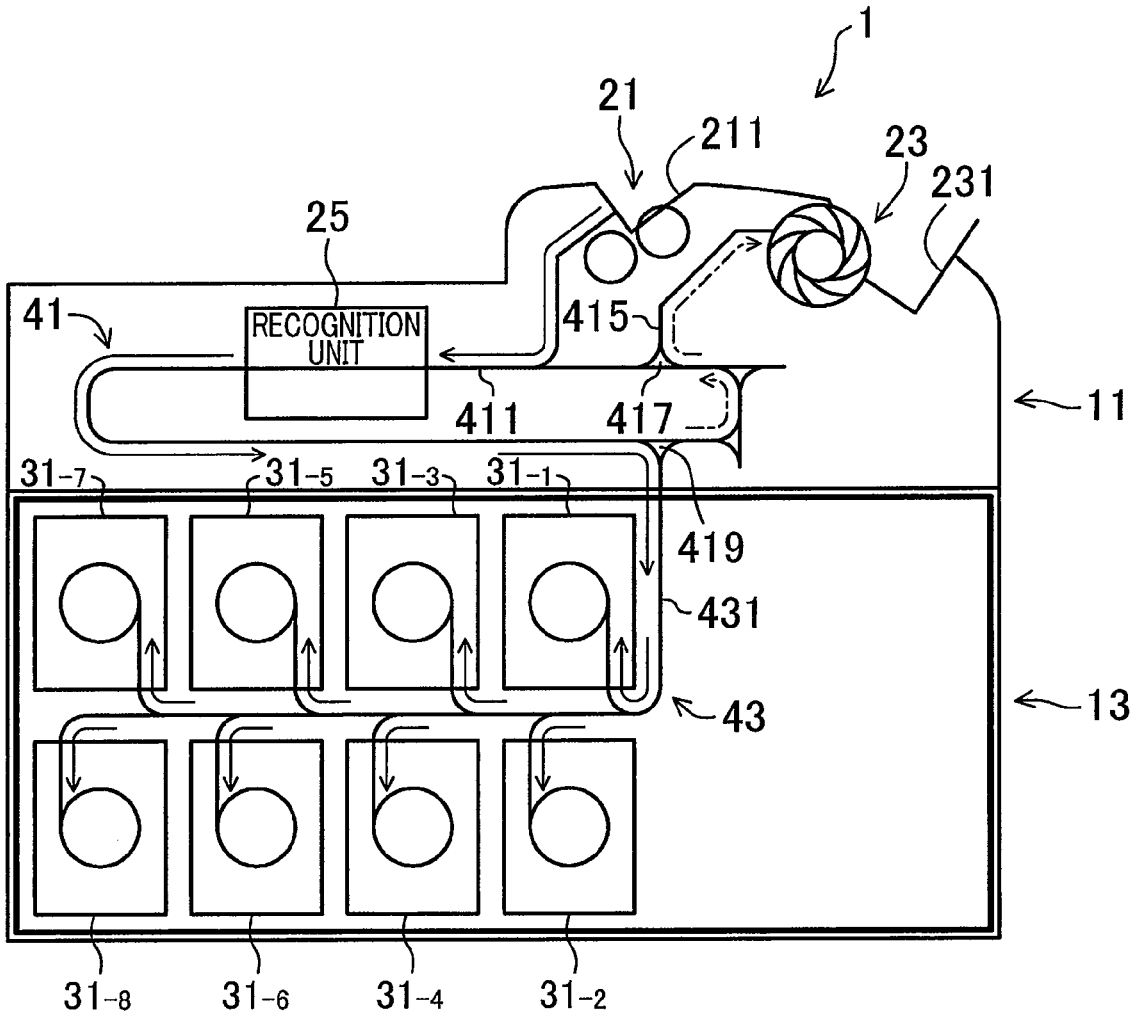
FIG. 4 shows a transport path for transporting banknotes in a depositing process.

The upper transport unit 41 transports the rejected banknotes which cannot be accepted by the depositing/dispensing machine 1, such as the banknotes which cannot be authenticated by the recognition unit 25, from the looped transport path 411 to the dispensing path 415 through the diverter 417 as indicated by dot-and-dash arrows in FIG. 4. The rejected banknotes are then dispensed to the outlet 231. The banknotes rejected in the depositing process are placed again in the inlet 211, and are recognized again by the recognition unit 25.

When the storage modules 31 become full in the depositing process, and the banknotes cannot be stored any more in the storage modules 31, these banknotes (overflowed banknotes) are also dispensed to the outlet 231. Although not shown, the overflowed banknotes are stored in the collection cassette 53 when the collection cassette 53 is attached to the depositing/dispensing machine 1.

The inventory amount stored in the memory unit 59 is updated after the depositing process is finished.

(Depositing Process with the Escrow Unit Attached)

Figure 5:
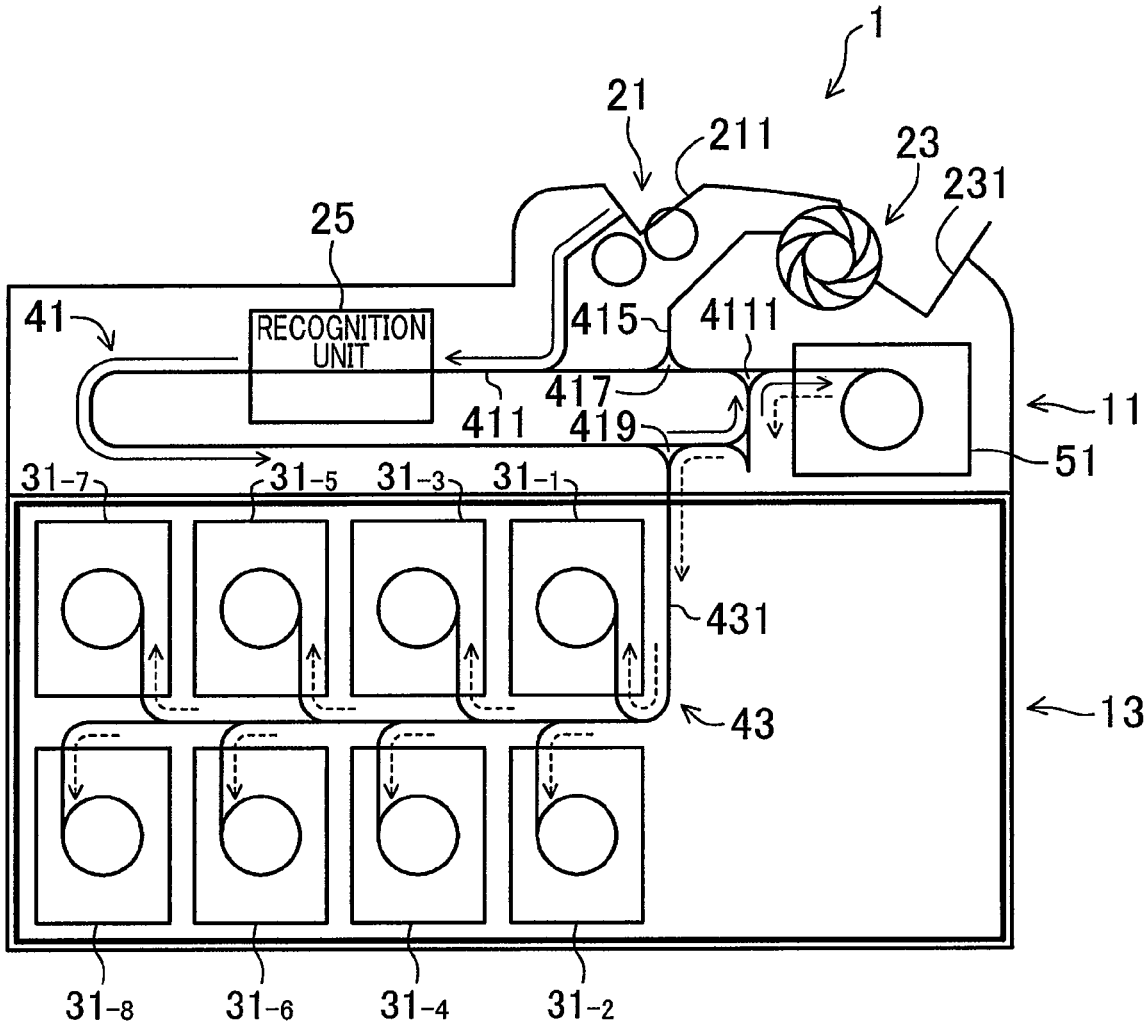
FIG. 5 shows a transport path for transporting the banknotes in the depositing process using an escrow unit.

FIG. 4 shows the depositing process performed without providing the escrow unit 51 in the depositing/dispensing machine 1. FIG. 5 shows the depositing process performed with the escrow unit 51 provided in the depositing/dispensing machine 1. Also in this example of FIG. 5, in the same manner as shown in FIG. 4, the feeding mechanism of the depositing unit 211 feeds the banknotes placed in the inlet 211 one by one, and the upper transport unit 41 transports the banknotes to the recognition unit 25. The upper transport unit 41 transports the normal banknotes recognized as acceptable by the recognition unit 25 from the looped transport path 411 to the escrow unit 51 through the second diverter 4111 as indicated by solid arrows in FIG. 5 to store the banknotes in the escrow unit. The rejected banknotes are dispensed to the outlet 231.

When the banknotes placed in the inlet 211 are all fed, and all the fed banknotes are counted, the result of the counting is displayed on the higher-ranking machine and/or the optional display unit 511. The operator checks the result, and then performs predetermined operation at the higher-ranking machine and/or the operation unit 55. Thus, the escrow unit 51 feeds the banknotes stored therein one by one, and the upper transport unit 41 transports the fed banknotes to the lower transport path 431 through the looped transport path 411 and the first diverter 419 as indicated by dot arrows in FIG. 5. Then, the lower transport unit 43 sorts the banknotes by the denomination or fitness based on the results of the recognition by the recognition unit 25 and the predetermined types of the banknotes allocated to the storage modules to store the banknotes in the storage modules 31. When the operator performs predetermined canceling operation instead of the storing operation, the banknotes stored in the escrow unit 51 are dispensed to the outlet 231.

(Dispensing Process)

The dispensing process is a process for dispensing the banknotes stored in the depositing/dispensing machine 1. Specifically, the dispensing process is started by performing predetermined dispensing operation of specifying the amount of money to be dispensed or the denomination and the number of the banknotes at the higher-ranking machine and/or the operation unit 55. The storage unit 3 feeds the specified number of the banknotes of the specified denomination from the storage module 31 as indicated by solid arrows in FIG. 6. The lower transport unit 43 transports the fed banknotes to the looped transport path 411 of the upper transport unit 41 through the transport path 431. The upper transport unit 41 transports the banknotes to the recognition unit 25, and transports the banknotes recognized by the recognition unit 25 from the looped transport path 411 to the dispensing path 415 through the diverter 417. Thus, the banknotes are dispensed to the outlet 231. The inventory amount stored in the memory unit 59 is updated after the dispensing process is finished.

When the number of the dispensed banknotes exceeds the capacity of the outlet 231, the banknotes may be dispensed in several times, i.e., a divisional dispensing process is performed. Specifically, in the divisional dispensing process, the process is suspended when the banknotes not more than the capacity of the outlet 231 are dispensed, the dispensed banknotes are removed from the outlet 231, and then the dispensing process is restarted. The suspension and the restart of the process are repeated based on the number of the banknotes to be dispensed.

Figure 6:
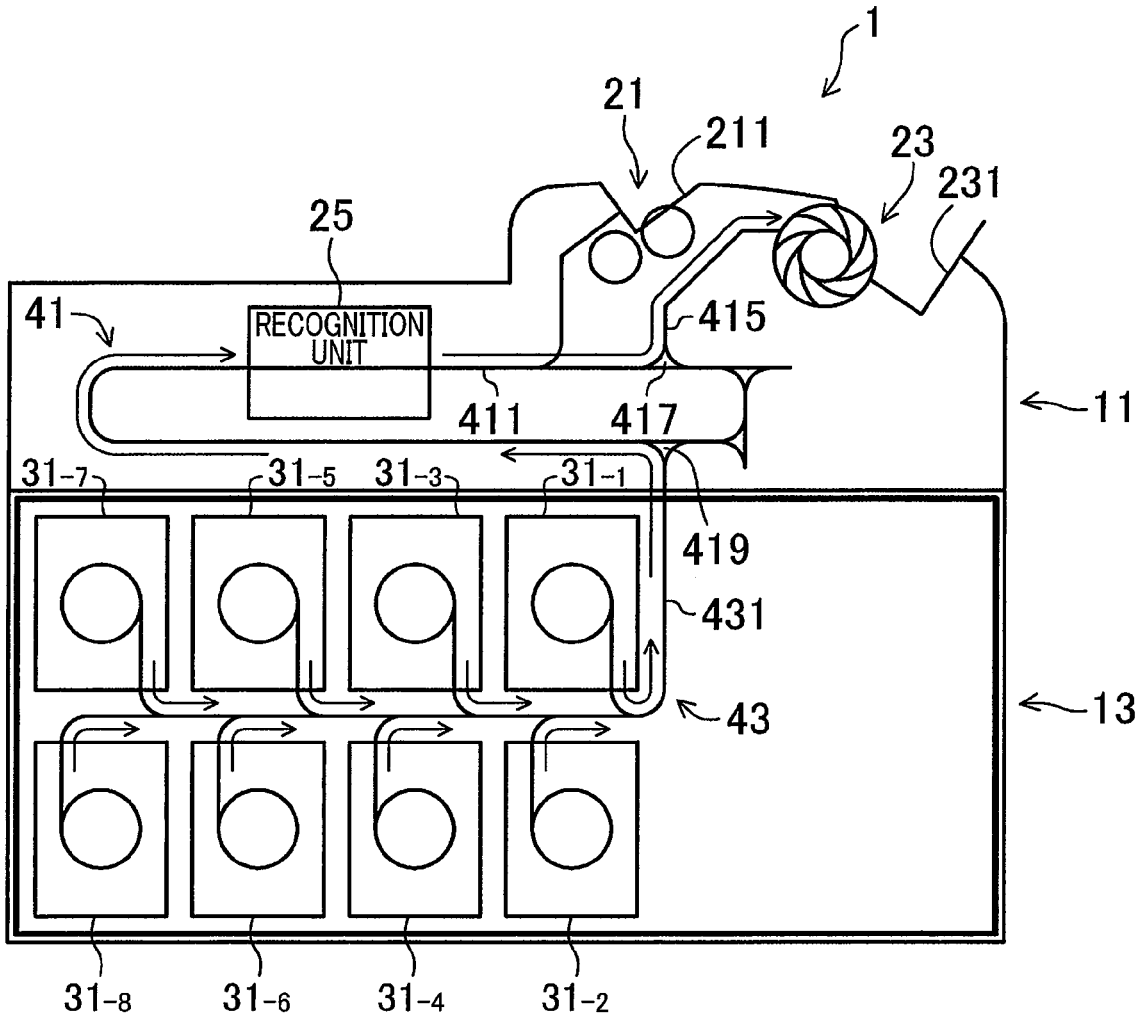
FIG. 6 shows a transport path for transporting the banknotes in a dispensing process.

When the depositing/dispensing machine 1 does not include the escrow unit 51 and the collection cassette 53 as shown in FIG. 6, the banknotes which are not recognizable by the recognition unit 25 and are rejected in the dispensing process are dispensed to the outlet 231 together with the normal banknotes. Thus, when the banknotes are rejected in the dispensing process, the depositing/dispensing machine 1 and/or the display unit 511 displays that the banknotes are rejected (error message). This can inform the operator that the rejected banknotes are contained in the banknotes dispensed to the outlet 231.

(Reconciliation Process)

In some cases, the banknotes recognized and counted by the recognition unit 25 may irregularly be transferred to the storage modules 31 in the depositing process. For example, the banknotes transferred on the transport paths 411, 431 may be skewed, may be connected without the predetermined gap therebetween, or may be overlapped. Such irregular transfer can be detected by checking the results of the recognition by the recognition unit 25 against the results of the detection by the sensors of the storage modules 31.

When the banknotes are connected or overlapped in the depositing process, the order of the banknotes is changed, and the banknotes may not be stored in the corresponding storage modules 31. In such a case, the denominations or the numbers of the banknotes stored in the storage modules 31 may be uncertain. Thus, when the irregular transfer occurs in the depositing process, a process of determining the denominations and the numbers of the banknotes stored in the storage modules 31 is required. This process is called a reconciliation process. The reconciliation process includes, feeding all the banknotes out of the storage module 31 which requires the reconciliation, recognizing and counting the fed banknotes by the recognition unit 25, and returning the banknotes to the storage module 31. The banknotes fed from the storage module 31 are temporarily stored in a different storage module 31 before or after the recognition. When the depositing/dispensing machine 1 includes the escrow unit 51, the banknotes may temporarily be stored in the escrow unit 51.

The irregular transfer occurred in the depositing process is detected by checking the results of the recognition by the recognition unit 25 against the results of the detection by the sensors of the storage modules 31 as described above. Thus, the irregular transfer is detected only after all the banknotes are stored in the storage modules 31. The reconciliation process needs to be performed on every storage module 31 in which at least one banknote is stored in the depositing process, and all the banknotes stored in the corresponding storage modules 31 need to be fed out. Thus, the reconciliation process tends to take long time. The more banknotes the storage modules 31 store, the longer time the reconciliation takes.

In the dispensing process described above, the number of the banknotes fed from the storage module 31 may become uncertain when the banknotes are connected or overlapped during the transfer, or one or more banknotes are rejected. Thus, the inventory amount in the storage module 31 after the dispensing process (the number of the banknotes stored in the storage module 31) becomes uncertain. Thus, the reconciliation process is performed on every storage module 31 from which at least one banknote is fed to determine the inventory amount in each of the storage modules 31.

In the depositing/dispensing machine 1, the time taken to perform the reconciliation process is reduced by storing the banknotes in the storage module 31 in an original manner. Thus, every banknote stored in the storage module 31 is not fed in the reconciliation process, but at least some of the banknotes are fed to perform the reconciliation process on the storage module 31, thereby reducing the time taken for the reconciliation process. The reconciliation process performed by feeding some of the banknotes stored in the storage module 31 may be referred to as a partial reconciliation process.

(Example of how the Banknotes are Stored in the Storage Module)

Figure 7:
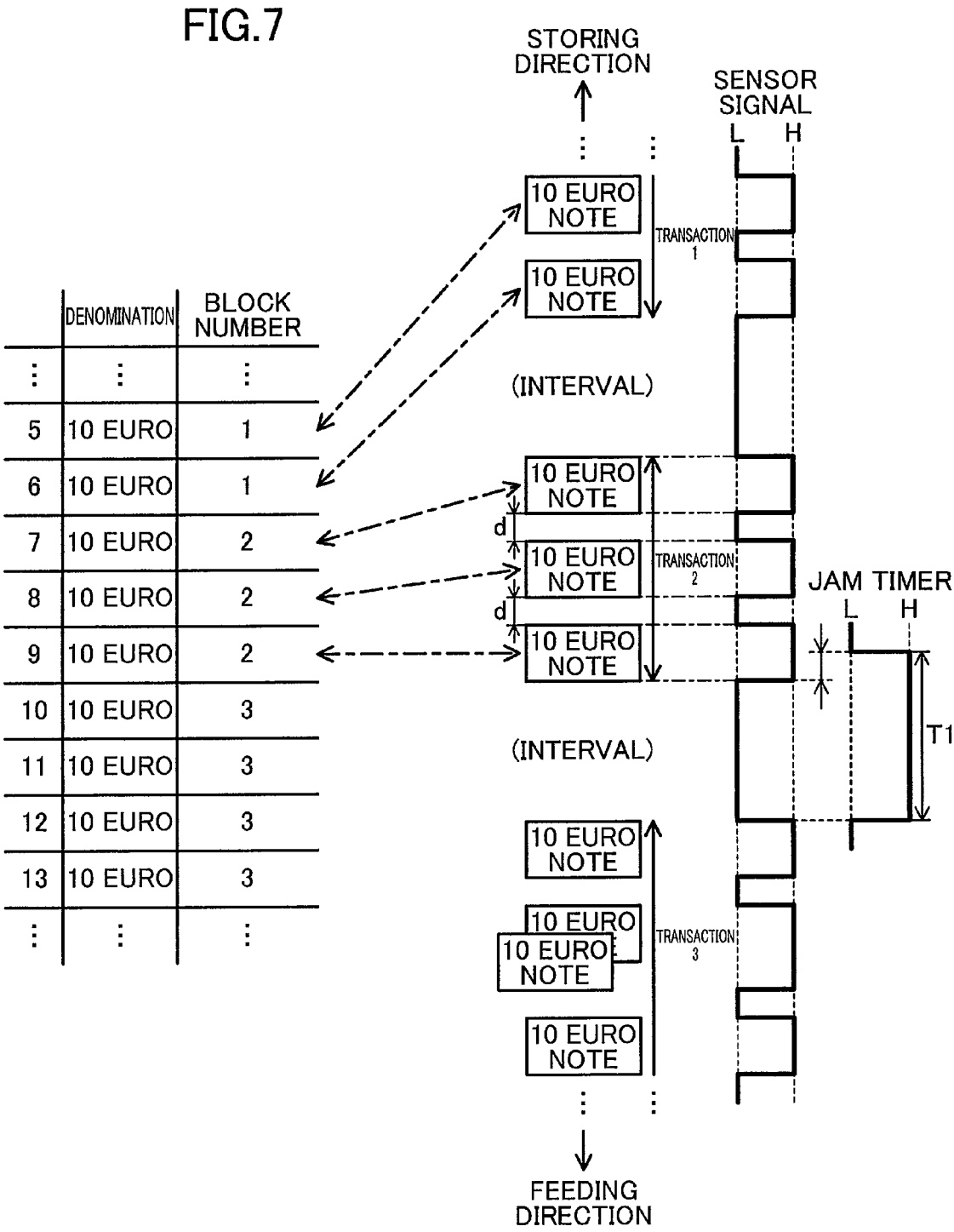
FIG. 7 shows how the banknotes are stored in a storage module, and a partial reconciliation process performed on the stored banknotes.

FIG. 7 shows an example of how the banknotes are stored in the storage module 31. FIG. 7 shows in a center part the banknotes wound on the reel 311 of the winding storage module 31 in a developed view. The upward direction in FIG. 7 corresponds to a direction radially inward of the reel 311, and the downward direction in FIG. 7 corresponds to a direction radially outward of the reel 311. Thus, the upper banknote shown in FIG. 7 is stored earlier in the storage module 31, and the lower banknote shown in FIG. 7 is stored later in the storage module 31. When the banknotes are fed from the storage module 31, the banknotes are sequentially fed out from the lower banknote.

As described above, in the depositing process, the banknotes are wound on the reel 311 with a predetermined distance d kept between each of the banknotes. In the example shown in FIG. 7, an interval larger than the predetermined distance d is provided between every depositing process (between every transaction).

The memory unit 59 stores pieces of storage information corresponding to each storage module 31, each of which associating a consecutive number, denomination, and a block number of the banknote with each other as shown in a left part of FIG. 7. The consecutive number is given to each of the banknotes stored in the storage module 31, and indicates the number of the banknotes stored in the storage module 31. The "block number" is given to a set of the banknotes stored in the storage module 31 in a period between the adjacent intervals, and can be considered as a "transaction number." Thus, the consecutive number, i.e., the inventory amount in the storage module 31, can be associated with the block number, i.e., the interval, by associating the consecutive number and the block number. In the example shown in FIG. 7, the banknotes wound on the reel 311 and the pieces of storage information are associated as indicated by dot-and-dash arrows. The pieces of storage information stored in the memory unit 59 are updated every time the depositing process is performed.

Suppose that the banknotes are irregularly transferred in the depositing process. In this example, the depositing process in which the irregular transfer has occurred is "transaction 3" as shown in FIG. 7. "Transaction 1" and "transaction 2" are depositing processes performed before the transaction 3, and the irregular transfer does not occur in the transactions 1 and 2. The inventory amounts in the storage module 31 after the transaction 1 and after the transaction 2 have been determined by the pieces of storage information stored in the memory unit 59.

Since the irregular transfer occurred in the transaction 3, the reconciliation process needs to be performed on the corresponding storage module 31 after the transaction 3 is finished. At this time, only the banknotes which were wound on the reel 311 after the last interval are fed from the storage module 31. Specifically, only the banknotes stored in the storage module 31 in the transaction 3 are fed from the storage module 31 to perform the reconciliation process. Since at least the inventory amount in the storage module 31 after the transaction 2 has been determined, the inventory amount of the storage module 31 can be determined based on the inventory amount after the transaction 2 and the results of the reconciliation process. Thus, with the provision of a mark associated with the inventory amount of the storage module 31 (i.e., the interval in this example) in storing the banknotes, the reconciliation process can be performed by feeding only some of the banknotes, without feeding every banknote stored in the storage module 31. This can reduce the time for the reconciliation process. The banknotes wound in the transaction 3 may be fed as described above. However, for example, the banknotes stored in the depositing process in which the irregular transfer occurred (the transaction 3) and the banknotes stored in the depositing process immediately before the depositing process in which the irregular transfer occurred (the transaction 2) may be fed out of the storage module. The number of the fed banknotes may optionally be determined.

The interval can be detected based on the signal from the sensor arranged near the opening of the storage module 31 as shown in a right part of FIG. 7. Specifically, when a gap larger than the predetermined distance d is detected in feeding the banknotes, i.e., when the interval is detected, the feeding of the banknotes from the storage module 31 can be stopped. The interval may preferably be smaller than a gap corresponding to time T1 for a jam timer to detect jamming of the banknotes. This can prevent erroneous detection of the jamming of the banknotes.

The interval can be detected based on the signal from the sensor arranged near the opening of the storage module 31 as shown in a right part of FIG. 7. Specifically, when a gap larger than the predetermined distance d is detected in feeding the banknotes, i.e., when the interval is detected, the feeding of the banknotes from the storage module 31 can be stopped. The interval may preferably be smaller than a gap corresponding to time T1 for a jam timer to detect jamming of the banknotes. This can prevent erroneous detection of the jamming of the banknotes.

When the reconciliation process is required in the dispensing process, the banknotes can be fed from the storage module 31 until the intended interval is detected. For example, when the banknotes are fed until the last provided interval is detected, the number of the fed banknotes can be minimized, thereby advantageously reducing the time for the reconciliation process. Thus, the partial reconciliation process can be performed after the dispensing process, like the reconciliation process performed after the depositing process.

When the interval is provided between every transaction, the number of the intervals may be too large, and the number of the banknotes stored in the storage module 31 may be reduced. Thus, instead of providing the interval between every transaction, the interval may be provided every time the number of the banknotes stored in the storage module 31 exceeds the predetermined number. This can reduce the number of the intervals as compared with the case where the interval is provided between every transaction, and can avoid reduction of the capacity of the storage module 31 due to the increased number of the intervals. Further, this eliminates the need to feed every banknote stored in the storage module 31 in the reconciliation process as described above, and the time for the reconciliation process can be reduced. This is particularly advantageous in striking a balance between ensuring the storage capacity and reducing the time for the reconciliation.

The partial reconciliation process can be performed by providing the mark associated with the inventory amount in the storage module 31. Marks except for the above-described intervals between the banknotes can also be used. For example, an example where a serial number of each banknote is used as the mark, and an example where a position of the banknote on the tape winding the banknotes in the storage module 31 (tape address) is used as the mark will be described below. Specifically, the mark for performing the partial reconciliation process may be a physical mark including shapes and physical quantities, such as the intervals between the banknotes, the position of the banknote on the tape, and a logical mark stored as data, such as the serial number. The marks may be used alone, or may be used in combination to improve reliability.

(Example of how the Banknotes are Stored Using the Serial Number)

Figure 8:
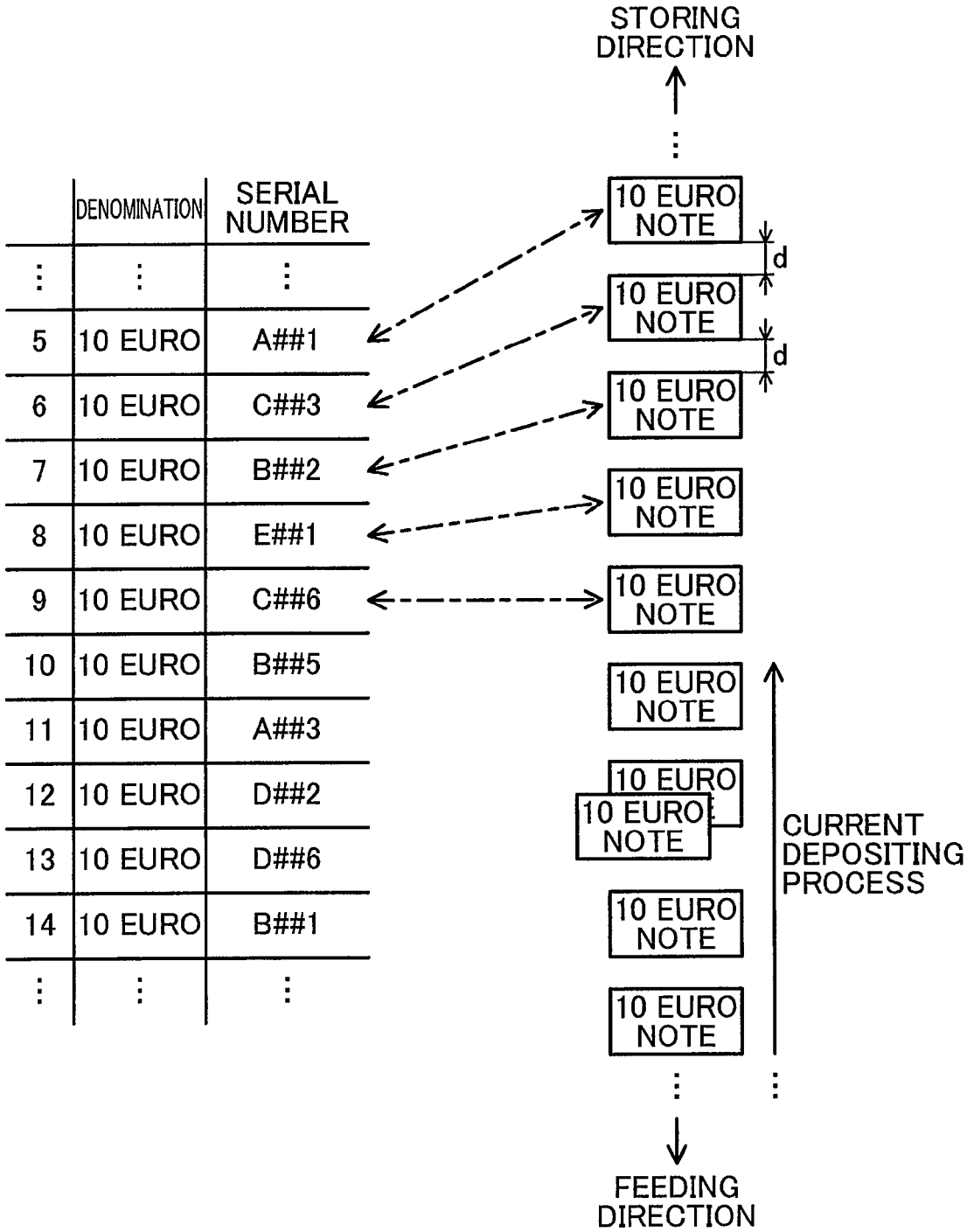
FIG. 8 shows how the banknotes are stored in the storage module while recording serial numbers of the banknotes.

FIG. 8 shows how the banknotes are stored in the storage module 31 using the serial numbers of the banknotes. In this example, the banknotes are wound on the reel 311 with the predetermined distance d provided therebetween, but without the intervals between the banknotes, as shown in FIG. 8.

In this example, the serial numbers need to be read and stored in storing the banknotes in the storage module 31. For example, the recognition unit 25 may read the serial numbers. In this case, the recognition unit 25 may be configured to recognize authenticity, fitness, and denomination of each of the banknotes, and to optically read the serial number printed on each of the banknotes. A reading unit different from the recognition unit 25 may be provided on the looped transport path 411, for example, to read the serial number. The serial number read in this manner is associated with the consecutive number and the denomination as a piece of information for each of the storage modules 31, and is stored in the memory unit 59 as shown in a left part of FIG. 8. Thus, the inventory amount (i.e., the consecutive number) and the mark (i.e., the serial number) are associated with each other. In the example shown in FIG. 8, the banknotes wound on the reel 311 and the pieces of storage information are associated as indicated by dot-and-dash arrows. The pieces of storage information stored in the memory unit 59 are updated every time the depositing process is performed as described above.

In this configuration, when the irregular transfer has occurred in the depositing process, and the reconciliation process is required, "the banknotes stored in the storage module 31 in the depositing process" and "at least one more banknote" are fed from the storage module 31. Then, the fed banknotes are recognized and counted, and at least the serial number of the last fed banknote is read. The read serial number is checked against the serial number contained in the pieces of storage information stored in the memory unit 9. When the read serial number is found in the storage information, the denomination and the number of the banknotes stored before the last fed banknote have been determined by the storage information in the memory unit. Thus, the feeding of the banknotes from the storage module 31 is stopped to finish the reconciliation process. When the read serial number is not found in the storage information, the feeding of the banknotes from the storage module 31 is continued until the banknote having the serial number contained in the storage information is fed.

When the reconciliation process is required in the dispensing process, the reconciliation process is performed by feeding the banknotes from the storage module 31 until the banknote having the serial number contained in the storage information is fed.

In this example, the serial number of the banknote is used as the mark, and at least some of the banknotes stored in the storage module 31 are fed for the reconciliation process. Thus, like the example using the intervals described above, the time for the reconciliation process can be reduced. Further, since the relatively large intervals are not provided between the banknotes wound on the reel 311, the capacity of the storage module 31 is not reduced.

Instead of reading and storing the serial number of every banknote, the serial number may be read and stored every time a predetermined number of the banknotes has passed, or the serial number of the banknote wound last time in each transaction may be read and stored. These reading and storing may be combined. This can advantageously save the storage capacity of the memory unit 59. In checking the serial number, whether alphabets and numerals constituting the serial number completely coincide with those of the stored serial number may be checked, or whether at least some of the alphabets and numerals coincide with those of the stored serial number may be checked. This may advantageously reduce the time for the reconciliation process. Whether at least some of the alphabets and numerals coincide with those of the stored serial numbers of more than one banknotes may be checked.

(Example of how the Banknotes are Stored Using Tape Address)

Figure 9:
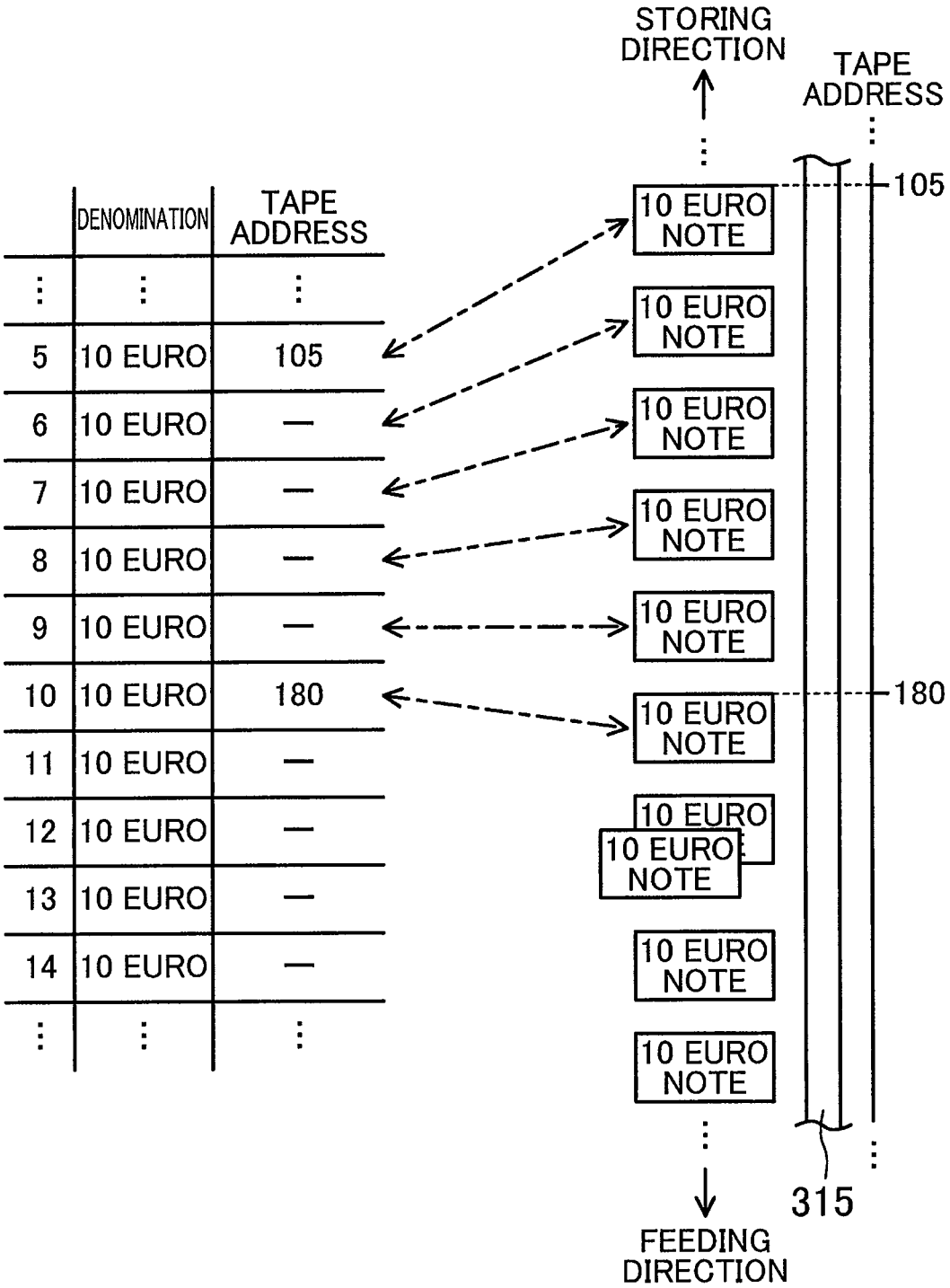
FIG. 9 shows how the banknotes are stored in the storage module while recording addresses on a tape.

FIG. 9 shows how the banknotes are stored using the tape address. As described above, the winding storage module 31 winds the banknotes by winding two tapes sandwiching the banknotes therebetween on the reel 311. Thus, as shown in FIG. 9, a lengthwise position on a tape 315 and each of the banknotes wound on the reel 311 are associated with each other. In this example, the lengthwise position on the tape 315 will be referred to as a "tape address," and is used as the mark. The lengthwise position on the tape 315 (i.e., the tape address) can be obtained by an output (pulse number) of an encoder which is provided in the storage module 31 to detect whether the tape 315 is fed or wound back. For example, calibration may be performed to associate the output of the encoder and the tape address by feeding and winding the tape 315 when the depositing/dispensing machine 1 is started (when the machine is in an initial state).

In this example, the tape address corresponding to the wound banknote is specified by the output of the encoder every time the predetermined number of the banknotes is stored in the storage module 31 in the depositing process. Then, the tape address is associated with the consecutive number and the denomination, and is stored as the storage information in the memory unit 59. Thus, the inventory amount (i.e., the consecutive number) and the mark (i.e., the tape address) are associated with each other. The address on the tape 315 may not be stored every time the predetermined number of the banknotes is stored, but the tape address corresponding to each banknote may be stored. The tape address corresponding to the banknote which is first stored in the transaction, or the tape address corresponding to the banknote which is last stored in the transaction may be stored. The tape address associated with the number of the banknotes and the tape address associated with the transaction may be stored in combination. In the example shown in FIG. 9, the banknotes wound on the reel 311 and the pieces of storage information are associated with each other as indicated by dot-and-dash arrows. The pieces of storage information in the memory unit 59 are updated every time the depositing process is performed as described above.

In this configuration, when the irregular transfer has occurred in the depositing process, and the reconciliation process is required, the reconciliation process is performed by feeding the banknotes until the banknote which was stored in the storage module 31 before the current depositing process, and with which the address on the tape 315 is associated is fed. This is because the denomination and the number of the banknotes stored before the banknote with which the address on the tape 315 is associated have been determined by the storage information stored in the memory unit 59.

When the reconciliation process is required in the dispensing process, the banknotes are fed from the storage module 31 until the banknote corresponding to the stored tape address is fed.

In this example, the tape address is used as the mark, and at least some of the banknotes stored in the storage module 31 are fed to perform the reconciliation process. Thus, like the above-described example using the intervals, the time for the reconciliation process can be reduced. Further, since the relatively large intervals are not provided between the banknotes wound on the reel 311, the storage capacity of the storage module 31 is not reduced. The reconciliation process can be performed when the interval between the banknotes is associated with the tape address, instead of associating the banknote with the tape address.

(Shift from Dispensing Process to Counting Process)

As described above, the depositing/dispensing machine 1 is configured to dispense the banknotes rejected in the dispensing process to the outlet 231 together with the normal banknotes when the collection cassette 53 is not attached thereto (see FIG. 6). Thus, when one or more banknotes are rejected, the counting process is required to specify the banknotes and determine the number of the banknotes dispensed to the outlet 231. The inventory amount in the storage unit 3 may be uncertain unless the banknotes dispensed to the outlet 231 are counted. Since the depositing/dispensing machine 1 is configured to dispense the rejected banknotes to the outlet 231, the counting process must be performed when one or more banknotes are rejected in the dispensing process. The operator generally counts the dispensed banknotes manually or using a counting device (e.g., a banknote counter). This complicates the operator's work. When the rejected banknotes and the normal banknotes are both dispensed to the outlet 231, the number of the dispensed banknotes is quite large. The larger the number of the dispensed banknotes is, the larger load is imposed on the operator in counting the banknotes. Thus, regarding the machine which is configured to dispense the rejected banknotes to the outlet 231, reducing the load on the operator and suitably handling the banknotes are both required.

For the purpose of reducing the load on the operator and suitably handling the banknotes, the depositing/dispensing machine 1 is configured to go into standby for the counting process when one or more banknotes are rejected in the dispensing process.

Figure 10:
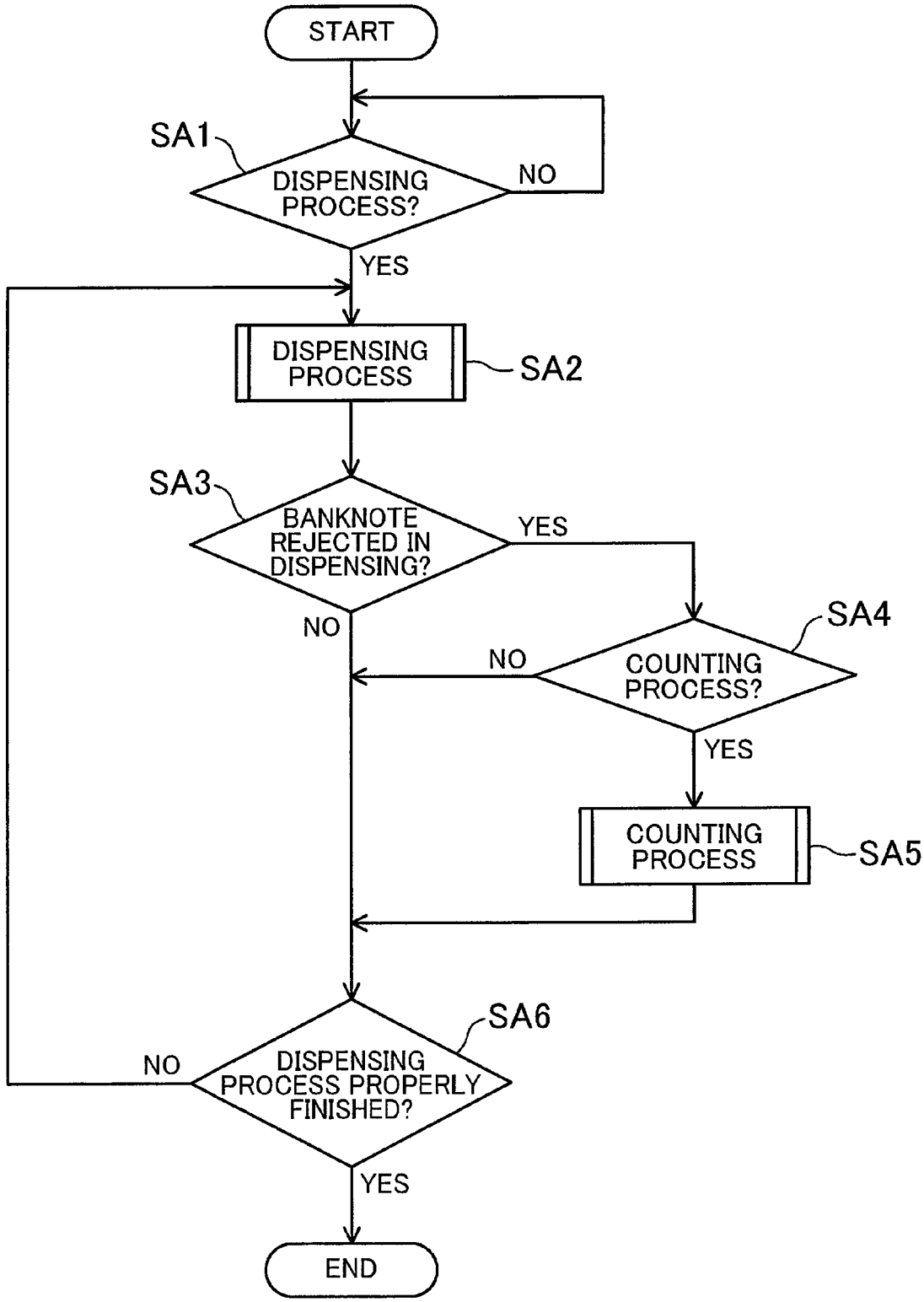
FIG. 10 shows a flowchart of a dispensing process performed by the banknote depositing/dispensing machine.

FIG. 10 shows a flowchart of the dispensing process of the depositing/dispensing machine 1. In step SA1 immediately after the start, whether or not a command to perform the dispensing process is input by the operator is determined. When the command to perform the dispensing process is not input (NO is selected), step SA1 is repeated. Specifically, the machine waits until the command to perform the dispensing process is input. When the command to perform the dispensing process is input (YES is selected), the flow proceeds to step SA2. In step SA2, the dispensing process is performed as described above.

In step SA3, whether or not one or more banknotes are rejected in the dispensing process is determined. When the banknotes are not rejected (NO is selected), the flow is finished. When one or more banknotes are rejected (YES is selected), the flow proceeds to step SA4. At this time, the memory unit 59 stores a log of the dispensing process in which the banknotes are rejected as a log in which the dispensing process requires a counting process, together with the inventory amount before the dispensing process.

In step SA4, whether or not a command to perform the counting process is input by the operator is determined. Specifically, the depositing/dispensing machine 1 is configured in such a manner that the operator can optionally select whether the counting process is necessary or not after the dispensing process. For example, when the dispensing processes should sequentially be performed not to delay the teller's work, the counting process may be performed after the dispensing processes are sequentially performed. Thus, in the depositing/dispensing machine 1, the operator optionally selects whether the counting process should be performed after the dispensing process or not. This can improve usability of the depositing/dispensing machine 1.

In step SA4, when the command to perform the counting process is not input (NO is selected), the flow proceeds to step SA6. In step SA6, whether the dispensing process is properly finished without rejecting the banknotes is determined. When the process is properly finished (YES is selected), the flow is finished. When the process is not properly finished (NO is selected), the flow returns to step SA2 to perform the dispensing process again.

In step SA4, when the command to perform the counting process is input (YES is selected), the flow proceeds to step SA5 to perform the counting process.

(Counting Process after Dispensing Process)

Figure 11:
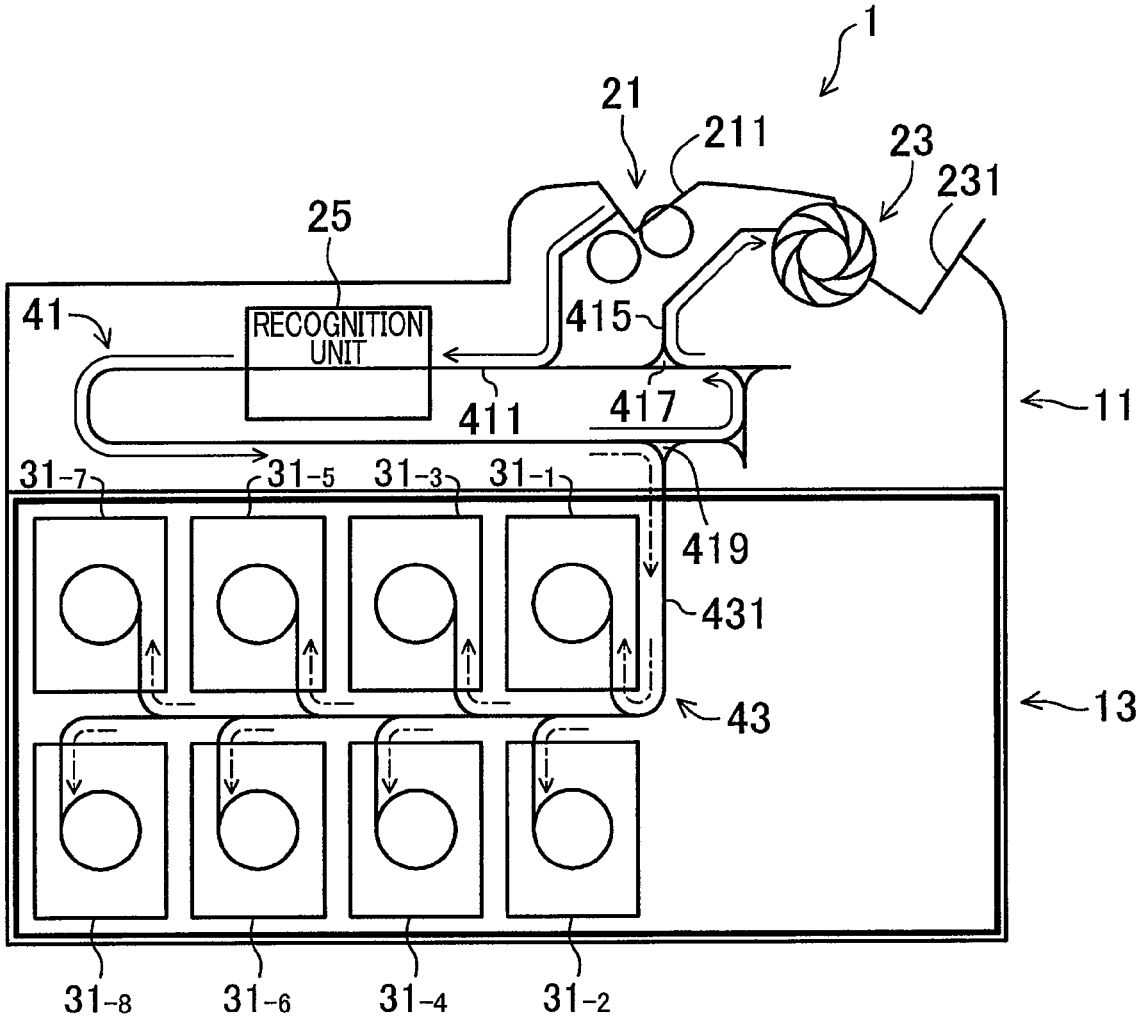
FIG. 11 shows a transport path for transporting the banknotes in a counting process.

The counting process after the dispensing process is started when the operator places every banknote dispensed to the outlet 231 (containing both the rejected banknotes and the normal banknotes) in the inlet 211, and performs predetermined operation to start the counting process. As shown in FIG. 11, the feeding mechanism of the depositing unit 21 feeds the banknotes in the inlet 211 one by one, and the upper transport unit 41 transports the banknotes to the recognition unit 25. The recognition unit 25 recognizes and counts the banknotes. The upper transport unit 41 transports the banknotes that have passed the recognition unit 25 to the dispensing path 415 through the looped transport path 411 and the diverter 417 as indicated by solid arrows in FIG. 11. Thus, every banknote is dispensed again to the outlet 231. The result of the counting process is displayed on the higher-ranking machine and/or the display unit 511 to inform the operator of the result.

Since the depositing/dispensing machine 1 performs the counting process after the dispensing process, there is no need for the operator to manually count the banknotes, thereby reducing the load on the operator. Further, since the depositing/dispensing machine 1 which performs the dispensing process can perform the counting process sequentially after the dispensing process, the operator's work is simplified, thereby further reducing the load on the operator. The depositing/dispensing machine 1 which can perform both of the dispensing process and the counting process can advantageously store the history and track the log.

The results of the counting process are displayed on the higher-ranking machine or the display unit 511 as described above. The operator can be informed of the number of the banknotes dispensed in the dispensing process. Thus, the operator can manually determine the inventory amount in the storage unit 3 after the dispensing process. Alternatively, the inventory amount in the storage unit 3 of the depositing/dispensing machine 1 may automatically be determined based on the results of the counting process. Specifically, the results of the counting process are the numbers of the banknotes of different denominations dispensed in the dispensing process which requires the counting process. Thus, the inventory amount after the dispensing process can be determined by subtracting the results of the counting process from the inventory amount before the dispensing process.

When one or more banknotes are rejected in the counting process, information about the rejected banknotes (denomination and number) may manually be input by the operator, and the memory unit 59 stores the information. Then, the inventory amount of the depositing/dispensing machine 1 can be determined based on the results of the counting process and the information about the rejected banknotes stored in the memory unit 59.

When one or more banknotes are rejected in the dispensing process, the counting process and the reconciliation process may be performed so that the results of the counting process and the results of the reconciliation process can be checked against the inventory amount in the storage unit 3 before the dispensing process. In this configuration, when some of the banknotes escape from the inlet 211 in moving the banknotes from the outlet 231 to the inlet 211 to start the counting process after the dispensing process, the missing of some of the banknotes can be recognized. Specifically, the banknotes can more suitably be handled even when the banknotes are rejected in the dispensing process.

The reconciliation process may be a normal reconciliation process in which every banknote stored in the storage module 31 is fed, or may be the above-described partial reconciliation process.

When the banknotes are rejected in the dispensing process, a command to perform the dispensing process may be input before proceeding to the counting process to properly finish the dispensing process, thereby quickly finishing the operator's work at the teller window. The counting process may be performed after the dispensing process is properly finished. In this case, the banknotes dispensed to the outlet 231 (containing both of the rejected banknotes and the normal banknotes) can separately be kept until the counting process is started.

When the operator performs the counting process, the results of the counting process are manually input to associate the counting results with the log of the dispensing process which requires the counting process stored in the memory unit 59, thereby determining the inventory amount after the dispensing process. When the operator performs the counting process, the depositing/dispensing machine 1 does not need to perform the counting process. Thus, when the operator manually inputs the counting results, the machine 1 does not need to go into standby for the counting process. When the memory unit 59 stores a plurality of logs of the dispensing process which requires the counting process, the operator can manually select the log of the dispensing process with which the counting results are associated in inputting the results.

In the counting process after the dispensing process, the fit banknotes which can be stored in the storage unit 3 may be stored in the storage modules 31 as indicated by dot-and-dash arrows in FIG. 11. This allows effective use of the banknotes in the depositing/dispensing machine 1.

In the above-described configuration, the operator manually starts the counting process after the dispensing process is finished (step SA4 in FIG. 10). However, the counting process can automatically be started after the dispensing process.

In performing the divisional dispensing process, the counting process may be performed after all the banknotes are dispensed. Alternatively, the dispensing process may be suspended when the banknotes containing the rejected banknotes are dispensed, and then the counting process may be started. In this case, the dispensing process is restarted after the counting process is finished.

In the counting process after the dispensing process (in this specification, "after the dispensing process" may include the case where the dispensing process is suspended), the banknotes may merely be counted instead of recognizing and counting the banknotes. As long as the number of the banknotes fed from the depositing/dispensing machine 1 and the result of the counting process (the number of the banknotes) coincide with each other, the inventory amount can be determined based on the banknotes dispensed in the dispensing process.

When the depositing/dispensing machine 1 is provided with the escrow unit 51 as shown in FIG. 5, the banknotes rejected in the dispensing process may be stored in the escrow unit 51. In this configuration, the dispensing process can properly and quickly be finished by feeding only the normal banknotes to the outlet 231, and then the rejected banknotes stored in the escrow unit 51 may be counted. The rejected banknotes stored in the escrow unit 51 may be dispensed to the outlet 231 after the normal banknotes dispensed in the dispensing process are removed from the outlet 231, and then the rejected banknotes may be placed in the inlet 211 to perform the counting process. The inventory amount in the storage module 31 may manually or automatically be updated based on the count of the rejected banknotes. In particular, when the rejected banknotes are still unrecognizable, the operator may manually update the inventory amount in the storage module 31.

(Structure of Storage Module)

Figure 12:
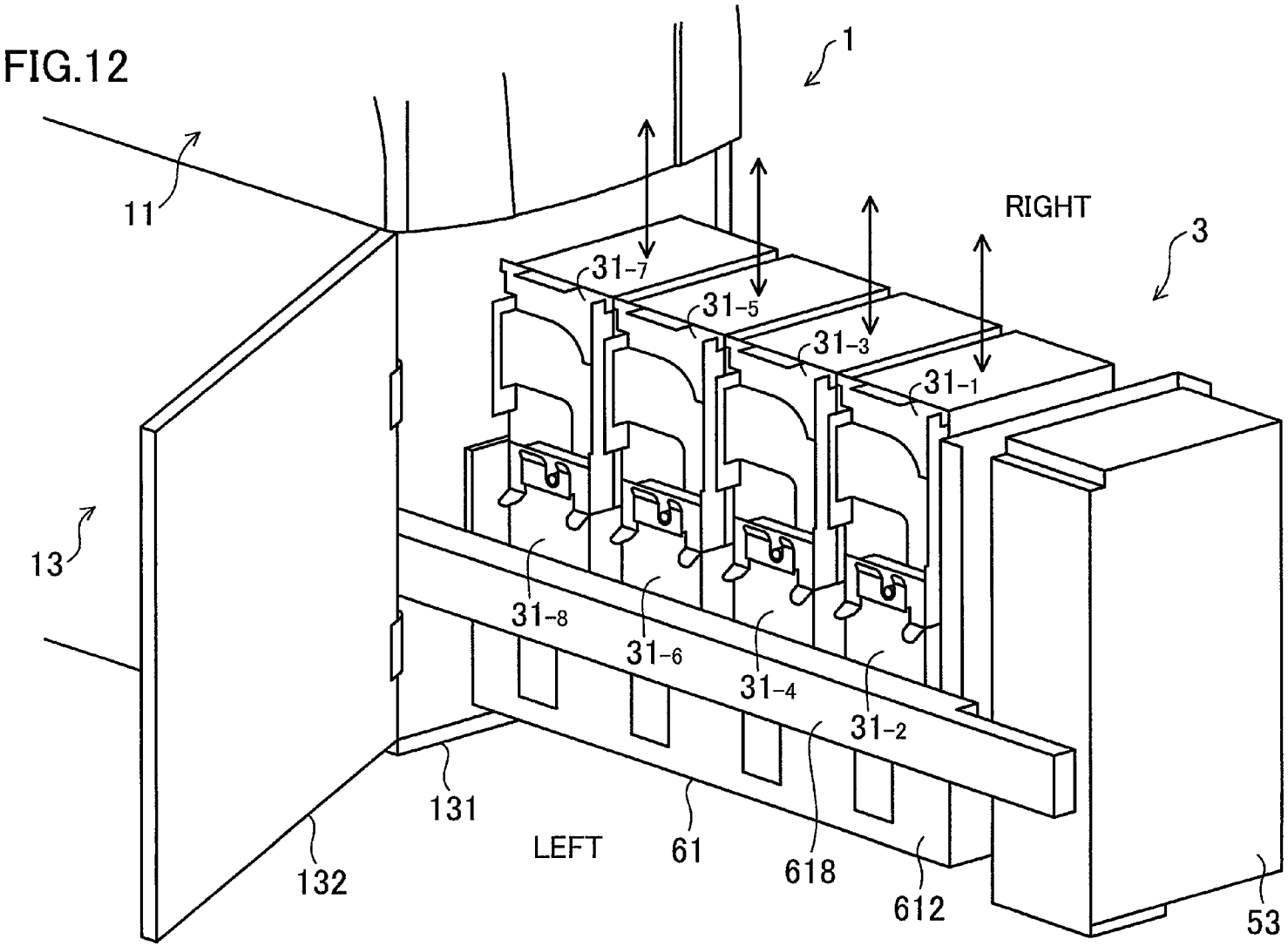
FIG. 12 is a perspective view of a storage unit pulled out of a safe unit.

FIG. 12 shows the storage unit 3 pulled out of the depositing/dispensing machine 1. As shown in FIGS. 1 and 12, a door 132 is attached to a front part of the safe unit 13 of the depositing/dispensing machine 1. When the door 132 is opened, a front opening of the safe unit 13 is opened so that the storage unit 3 contained in the safe unit 13 can be pulled forward of the depositing/dispensing machine 1. When the collection cassette 53 is attached to the depositing/dispensing machine 1 as shown in FIG. 12, the collection cassette 53 (or an additional storage module 31, if attached) is also pulled forward of the depositing/dispensing machine 1 together with the storage unit 3.

Figure 17:
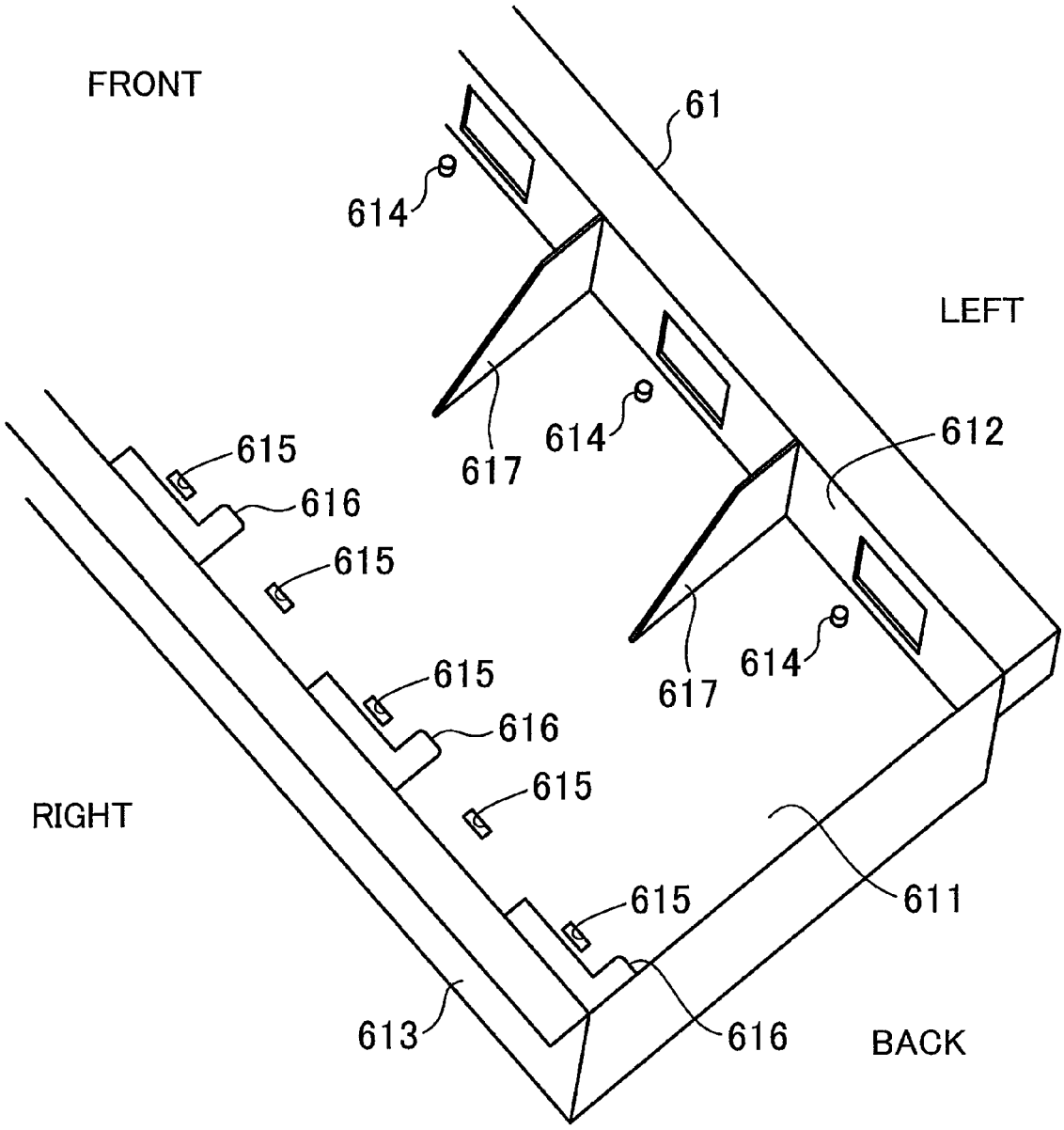
FIG. 17 is a perspective view of a tray.

Reference numeral 61 in FIG. 12 designates a substantially rectangular tray which is also shown in FIG. 17. The tray 61 includes a bottom plate 611, a left side plate 612, and a right side plate 613, and has an upward opening. Guide rails 618 extending in the front-back direction are provided on the left and right side plates of the tray 61, respectively (only the left guide rail is shown in FIG. 12). Although not shown, the guide rails 618 are slidably supported on supports provided on inner sidewalls of the protective casing 131 of the depositing/dispensing machine 1 so that the tray 61 can move back and forth relative to the depositing/dispensing machine 1. The tray 61 has a dimension in the front-back direction greater than a dimension in a right-left direction. As described in detail later, four storage modules, i.e., lower four storage modules $\mathbf{31}_{-2}$, $\mathbf{31}_{-4}$, $\mathbf{31}_{-6}$, $\mathbf{31}_{-8}$, are aligned in the tray 61 in the front-back direction. Additional storage modules are stacked on the storage modules 31 aligned in the front-back direction in the tray, respectively, i.e., upper four storage modules $\mathbf{31}_{-1}$, $\mathbf{31}_{-3}$, $\mathbf{31}_{-5}$, $\mathbf{31}_{-7}$ are aligned in the front-back direction.

Figure 13:
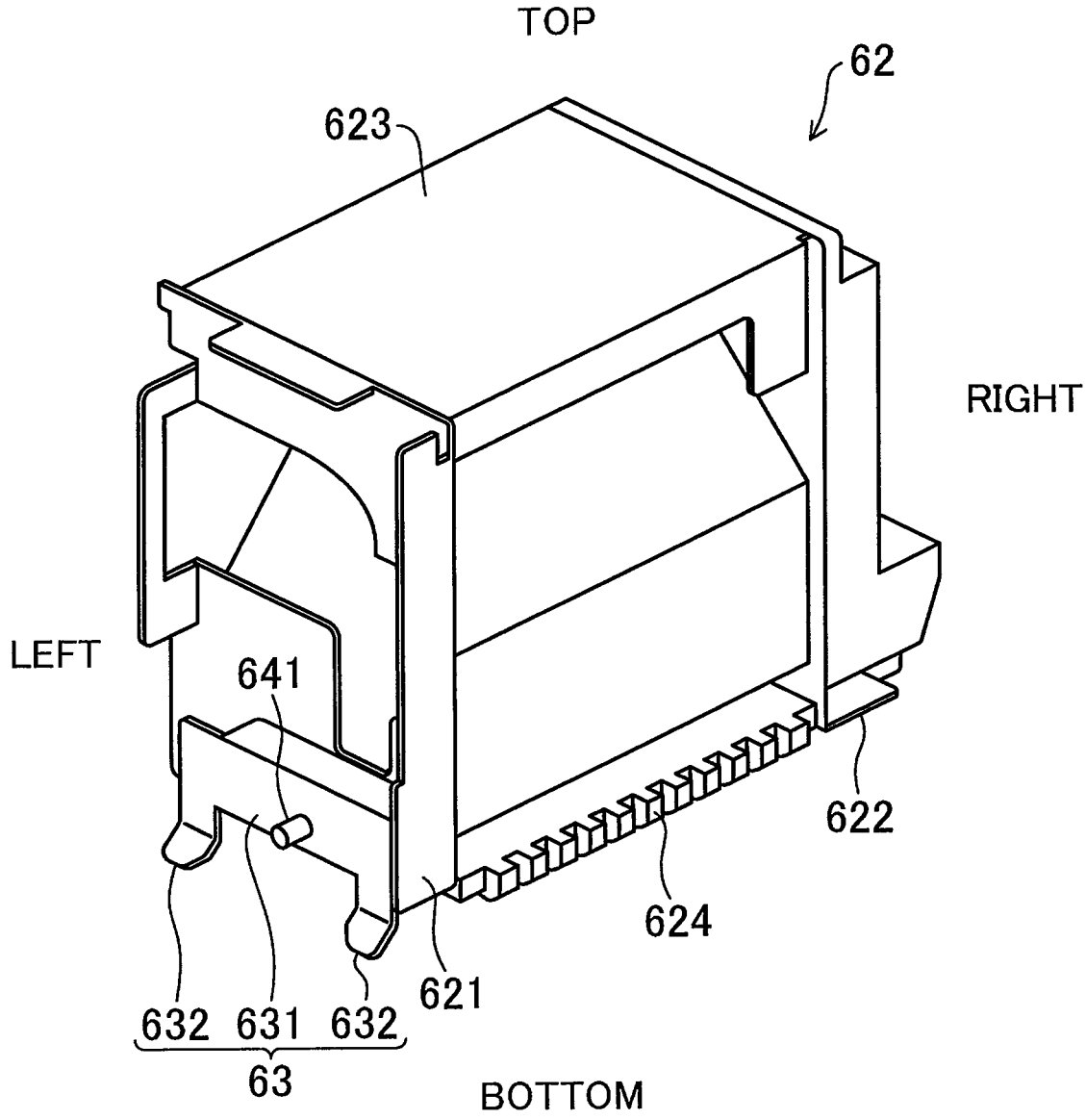
FIG. 13 is a perspective view of an upper storage module.
Figure 14:
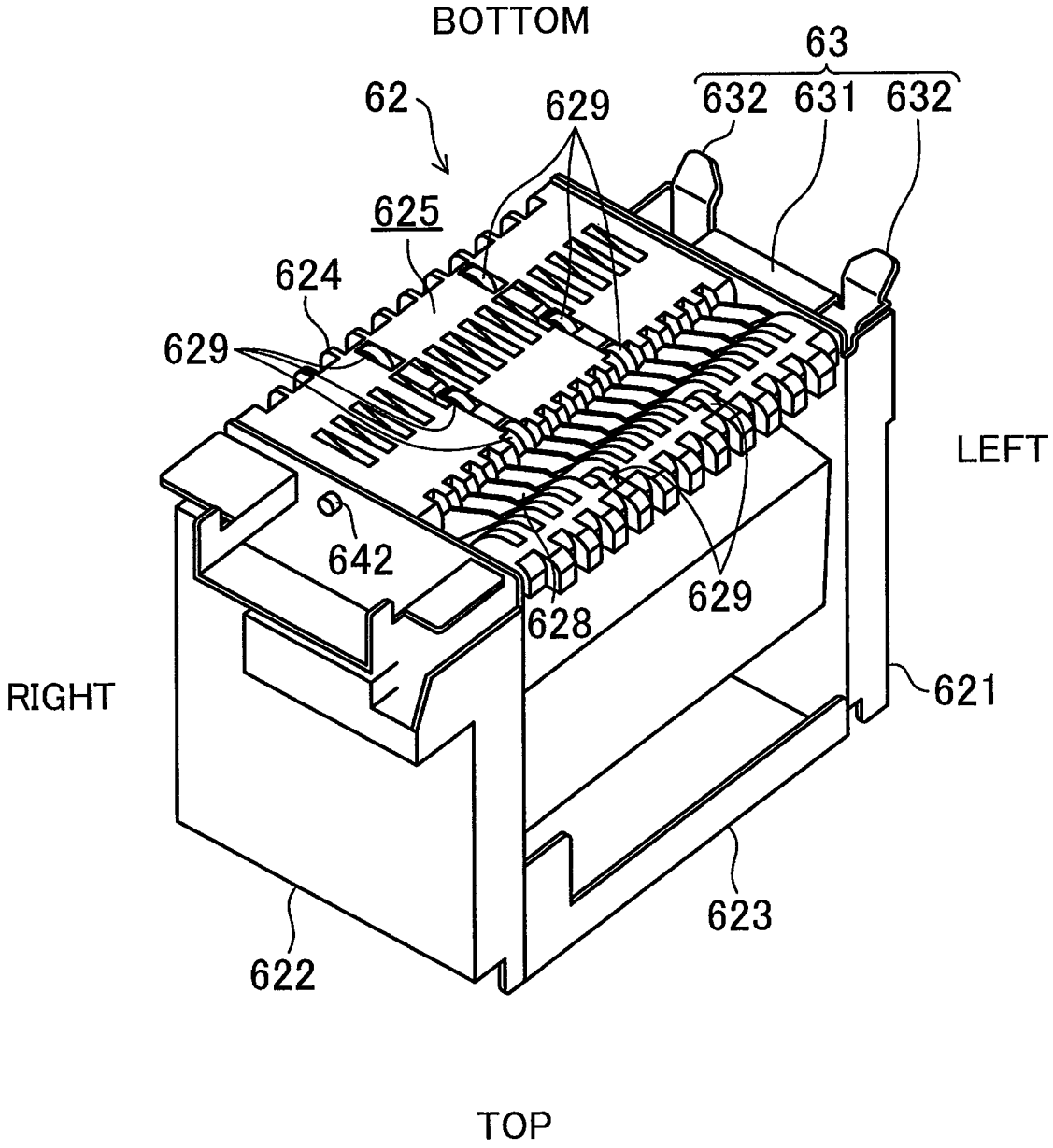
FIG. 14 is a perspective view of the upper storage module upside down.

FIGS. 13 and 14 show an appearance of the upper storage module. For easy understanding, the internal structure of the storage module is illustrated only partially in FIGS. 13 and 14. The storage modules stacked on the lower storage modules may be referred to as upper storage modules, and may be indicated by reference numeral 62. FIG. 14 shows the upper storage module 62 which is turned upside down, and is horizontally flipped relative to the upper storage module 62 shown in FIG. 13.

The upper storage module 62 includes a left side plate 621 and a right side plate 622. Upper ends of the left side plate 621 and the right side plate 622 are connected to each other through a top plate 623, and lower ends of the left side plate 621 and the right side plate 622 are connected to each other through a transport member 624 which partially constitutes the transport path between the storage modules 31 (i.e., a path branched from the transport path 431, hereinafter may be referred to as a transport path 432 (see FIG. 19)). A lower surface of the transport member 624 is a first transport surface 625 constituting an upper surface of the transport path 432. The first transport surface 625 includes a plurality of diverting members 628 constituting the sorters 433, and the diverting members 628 swing together. When the diverting members 628 protrude toward the transport path 431, the banknotes can be transported between the upper storage module 62 and the transport path 431. When the diverting members 628 are retracted in the upper storage module, the banknotes pass through the upper storage module 62. The first transport surface 625 is provided with a plurality of recessed grooves in which the diverting members 628 and diverting members 658 of a lower storage module 65 described later (see FIG. 15) move, and a plurality of transport rollers 629 for transporting the banknotes. FIG. 14 shows the diverting members 628 protruding from the first transport surface 625.

Figure 19:
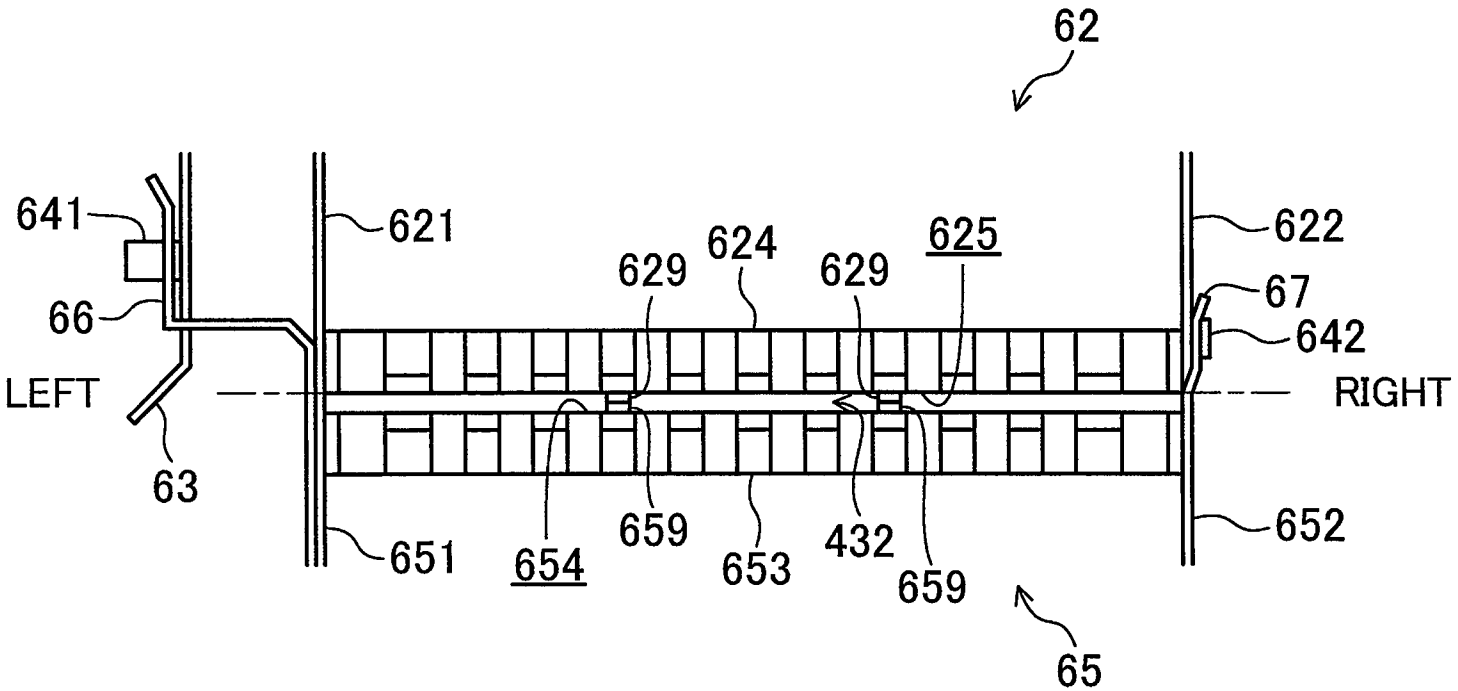
FIG. 19 is an enlarged front view showing connection between the upper storage module and the lower storage module.

A coupling plate 63 and a positioning pin 641 are attached to the left side plate 621 of the upper storage module 62. The coupling plate 63 includes a substantially rectangular body 631 fixed to the left side plate 621 of the upper storage module 62, and a pair of guiding parts 632, 632 extending downward from front and rear ends of the body 631 to protrude downward from a lower end of the upper storage module 62 as shown in an enlarged view of FIG. 19. Thus, the coupling plate 63 is generally in the shape of an inverted U. A lower end of each of the guiding parts 632 is inclined outward as shown in FIG. 19. Thus, as described in detail later, when the upper storage module 62 is attached to the lower storage module 65 from above, the guiding parts 632 guide the upper storage module 62 to position the upper storage module 62 relative to the lower storage module 65. The positioning pin 641 protrudes from the body 631 of the coupling plate 63 to the left.

As shown in FIG. 14, a positioning pin 642 is attached to a lower end of the right side plate 622 of the upper storage module 62 to protrude from an outer surface of the right side plate 622.

Figure 15:
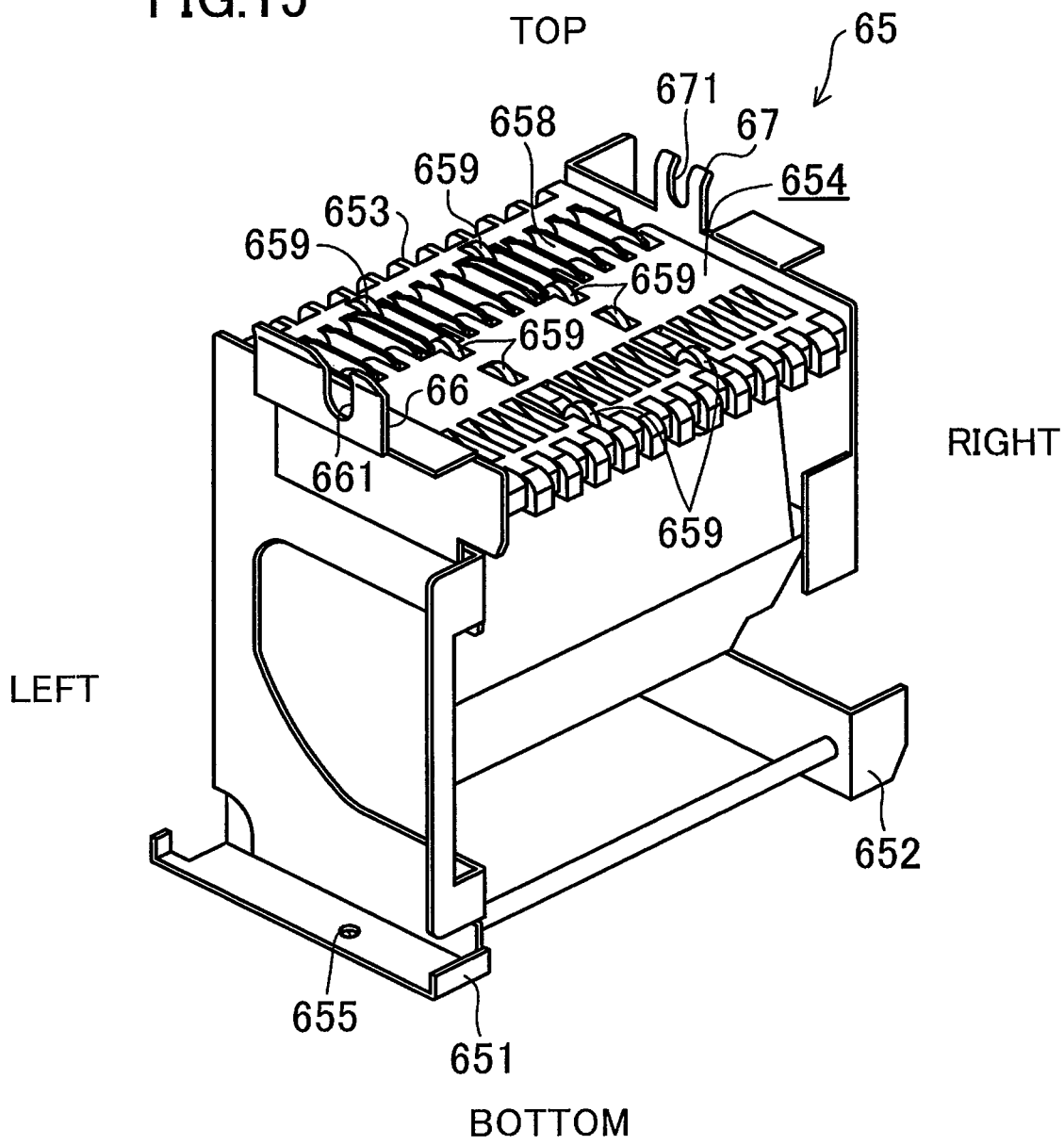
FIG. 15 is a perspective view of a lower storage module.
Figure 16:
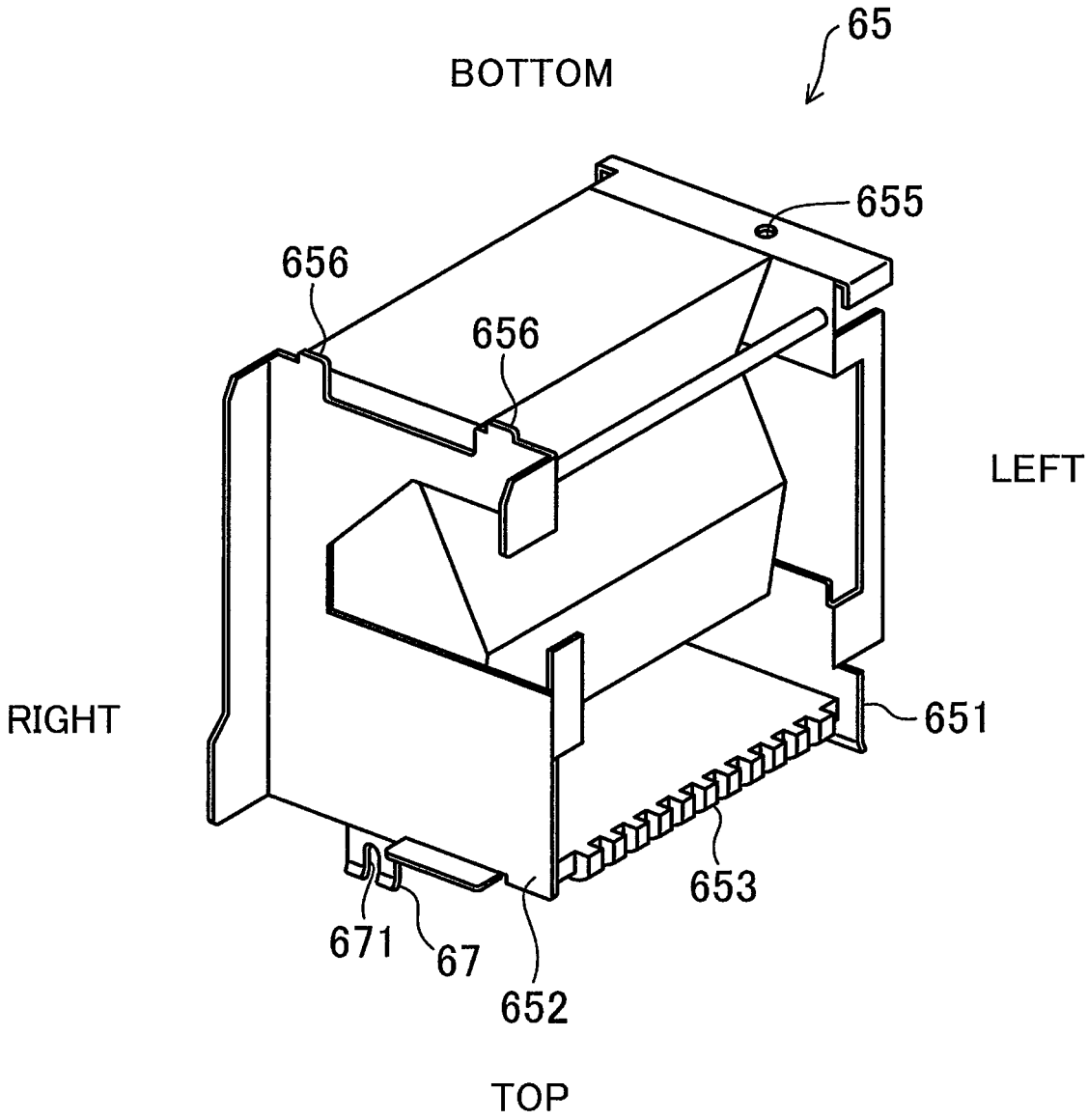
FIG. 16 is a perspective view of the lower storage module upside down.

FIGS. 15 and 16 show an appearance of the storage module arranged below the upper storage module. For easy understanding, the internal structure of the storage module is illustrated only partially in FIGS. 15 and 16. The storage module arranged below the upper storage module may be referred to as a lower storage module 65. FIG. 16 shows the lower storage module 65 which is turned upside down, and is horizontally flipped relative to the lower storage module 65 shown in FIG. 15.

The lower storage module 65 includes a left side plate 651 and a right side plate 652 like the upper storage module 62. Upper ends of the left side plate 651 and the right side plate 652 are connected to each other through a transport member 653 which partially constitutes the transport path 432 between the storage modules. An upper surface of the transport member 653 is a second transport surface 654 constituting a lower surface of the transport path 432. The second transport surface 654 is provided with a plurality of diverting members 658 constituting the sorters 433, and the diverting members 658 swing together. When the diverting members 658 protrude toward the transport path 431, the banknotes can be transported between the lower storage module 65 and the transport path 431. When the diverting members 658 are retracted in the lower storage module, the banknotes pass through the lower storage module 65. The second transport surface 654 is provided with a plurality of recessed grooves in which the diverting members 658 and the diverting members 628 of the upper storage module 62 (see FIG. 14) move, and a plurality of transport rollers 659 for transporting the banknotes. FIG. 15 shows the diverting members 658 retracted in the lower storage module 65.

A regulating plate 66 is provided at an upper end of the left side plate 651 of the lower storage module 65 to engage with the coupling plate 63 and the positioning pin 641 of the upper storage module 62. The regulating plate 66 is a substantially rectangular plate having a length corresponding to a distance between the pair of guiding parts 632, 632 of the coupling plate 63, and protrudes upward from an upper end of the lower storage module 65. A notch 661 which opens in an upper end of the regulating plate 66, and extends downward in the vertical direction is formed in the middle of the regulating plate 66 so that the positioning pin 641 of the upper storage module 62 is inserted in the notch 661. The upper end of the regulating plate 66 is inclined outward as shown in FIG. 19. Thus, when the upper storage module 62 is attached to the lower storage module 65 from above, the regulating plate 66 guides the upper storage module 62 to position the upper storage module 62 relative to the lower storage module 65.

A regulating tab 67 which engages with the positioning pin 642 of the upper storage module 62 is formed in an upper end of the right side plate 652 of the lower storage module 65. The regulating tab 67 protrudes upward from the right side plate 652 of the lower storage module 65, and is provided with a notch 671 which opens in an upper end of the regulating tab 67 and extends downward in the vertical direction. The upper end of the regulating tab 67 is inclined outward like the regulating plate 66 (see FIG. 19).

Figure 18:
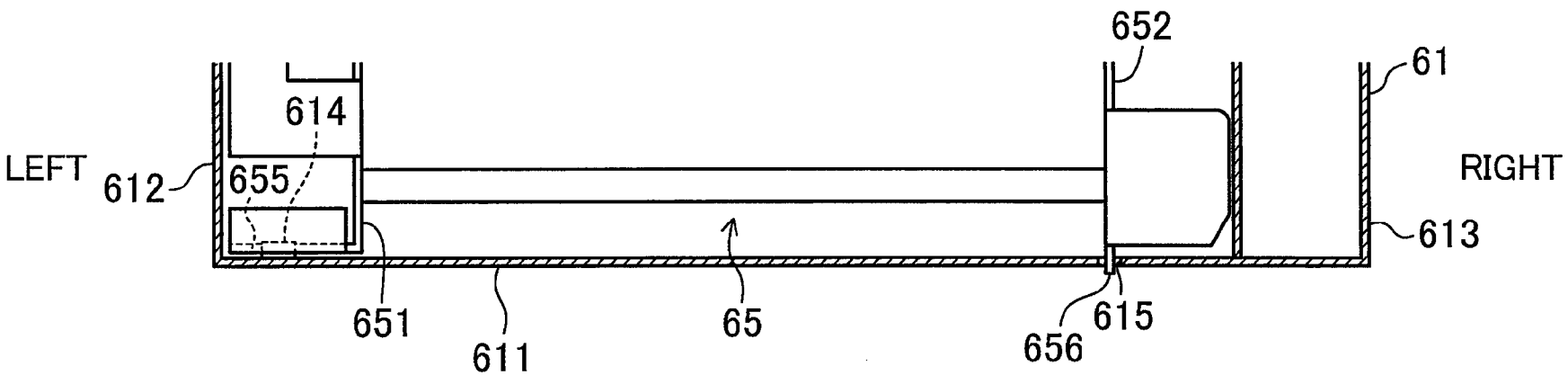
FIG. 18 is an enlarged cross-sectional view showing connection between the lower storage module and the tray.

A Hole 655 for fixing the lower storage module 65 to the tray 61, and insertion tabs 656 are formed in a lower end of the lower storage module 65. The hole 655 is provided to receive one of protrusions 614 formed at predetermined positions on the bottom plate 611 of the tray 61 as shown in FIGS. 17 and 18, and is formed in a lower end surface of the left side plate 651 of the lower storage module 65 as shown in FIGS. 15 and 16. Although FIG. 17 shows three protrusions 614 only, the tray 61 is actually provided with four protrusions 614 arranged at predetermined intervals in the front-back direction to correspond to the four lower storage modules 65 attached to the tray 61. Each of the insertion tabs 656 is inserted in a slit 615 formed at a predetermined position in the bottom plate 611 of the tray 61. As shown in FIGS. 16 and 18, two insertion tabs 656 are formed in the lower end surface of the right side plate 652 of the lower storage module 65 to protrude downward with an interval in the front-back direction kept therebetween. Although FIG. 17 shows five slits 615 only, but the tray 61 is actually provided with eight slits 615.

Guide members 616, each of which is L-shaped when viewed in plan, and divider plates 617 are attached to the tray 61 as shown in FIG. 17 to position the lower storage modules 65. Each of the guide members 616 is attached to the right side plate 613 of the tray 61, and abuts a right rear corner of the lower storage module 65, thereby positioning the lower storage module 65. The tray 61 includes four guide members 616. Each of the divider plates 617 extends inward from the left side plate 612 of the tray 61, and is positioned between two lower storage modules 65 adjacent to each other in the front-back direction to position the corresponding lower storage module 65. The tray 61 includes three divider plates 617.

The transport path 432 is formed by the first transport surface 625 and the second transport surface 654 facing each other as shown in FIG. 19. The banknotes transported through the transport path 432 are sandwiched between the transfer rollers 629 and the transfer rollers 659.

The upper storage modules 62 and the lower storage modules 65 configured as described above are attached to the tray 61 (i.e., to the body which is the protective casing 131 in which the tray 61 is contained) in the following manner. First, the lower storage module 65 is attached to the tray 61 by moving the lower storage module 65 downward toward the inside of the tray 61. At this time, the guide member 616 and the divider plate 617 of the tray 61 guide the lower storage module 65 to the predetermined position. Thus, as shown in FIG. 18, the insertion tabs 656 of the lower storage module 65 are inserted in the slits 615 of the tray 61, and the protrusion 614 of the tray 61 is inserted in the hole 655 of the lower storage module 65. Thus, the lower storage module 65 is completely attached to the tray 61. The lower storage module 65 is positioned in the front-back direction and the right-left direction relative to the tray 61 by the insertion tabs 656 and the slits 615, the hole 655 and the protrusion 614, the guide member 616, the divider plate 617, and the left and right side plates 612, 613. Likewise, the other three lower storage modules 65 are attached to the tray 61. Thus, although not shown, the upper surfaces of the transport members 653 of the four lower storage modules 65 aligned in the front-back direction constitute the second transport surface 654 extending in the front-back direction.

The upper storage modules 62 are attached to the four lower storage modules 65 attached to the tray 61, respectively. Thus, the upper storage modules 62 are attached to the tray 61, i.e., the protective casing 131, through the lower storage modules 65. Each of the upper storage modules 62 is stacked on the lower storage module 65 by moving the upper storage module 62 downward toward the lower storage module 65. At this time, the upper storage module 62 is guided to the predetermined position on the lower storage module 65 by the guiding parts 632 of the coupling plate 63 of the upper storage module 62 extending downward with outward inclination, the regulating plate 66 and the regulating tab 67 of the lower storage module 65 extending upward with outward inclination. Thus, as shown in FIG. 19, the left and right side plates 621, 622 of the upper storage module 62 abut the left and right side plates 651, 652 of the lower storage module 65 (see dot-and-dash lines in FIG. 19), respectively, the positioning pin 641 of the upper storage module 62 is inserted in the notch 661 in the regulating plate 66 of the lower storage module 65, and the positioning pin 642 of the upper storage module 62 is inserted in the notch 671 in the regulating tab 67 of the lower storage module 65. Thus, the upper storage module 62 and the lower storage module 65 are coupled, i.e., the upper storage module 62 and the lower storage module 65 are attached to the tray 61. The upper storage module 62 and the lower storage module 65 are properly positioned in the front-back direction by the engagement between the positioning pin 641 and the notch 661 and the engagement between the positioning pin 642 and the notch 671, and are properly positioned in the right-left direction by the regulating plate 66 abutting the outer surface of the coupling plate 63, and the regulating tab 67 abutting the outer surface of the right side plate 652 of the upper storage module 62. In this way, the upper storage modules 62 are coupled to the lower storage modules 65, respectively. Thus, the first transport surface 625 facing the second transport surface 654 and extending in the front-back direction can be formed by the lower surfaces of the transport members 624 of the four upper storage modules 62 aligned in the front-back direction. As shown in FIG. 19, the first transport surface 625 and the second transport surface 654 constitute the transport path 432 extending in the horizontal direction between the upper storage modules 62 and the lower storage modules 65.

When the lower storage modules 65 and the upper storage modules 62 are completely attached to the tray 61, the tray 61 is pushed into the protective casing 131 to contain the storage modules 62, 65 in the casing 131. With the storage modules contained in the casing, flat springs 133 provided inside the protective casing 131 press the top plates 623 of the upper storage modules 62 downward as schematically shown in FIG. 2. Thus, the upper storage modules 62 and the lower storage modules 65 are held not to move in the protective casing 131.

When the banknote is jammed in the transport path 432 between the upper storage module 62 and the lower storage module 65 in the operation of the depositing/dispensing machine 1, the door 132 of the safe unit 13 is opened to pull the tray 61 forward of the depositing/dispensing machine 1 as shown in FIG. 12. Thus, the upper storage modules 62 and the lower storage modules 65 are pulled outside the casing 131. When the upper storage modules 62 and the lower storage modules 65 are pulled out, the flat springs 133 no longer hold the storage modules, and the upper storage modules 62 (and the lower storage modules 65) can be detached from the tray 61.

The upper storage modules 62 can easily be detached from the lower storage modules 65 (or the tray 61) by pulling the upper storage modules upward as indicated by arrows in FIG. 12, i.e., in a direction opposite the direction of attaching the upper storage modules. When the upper storage modules 62 are detached, the second transport surface 654 of the transport path 432 constituted of the upper surfaces of the lower storage modules 65 is exposed upward. Thus, since the upper storage modules 62 and the lower storage modules 65 are independent from each other, the upper storage modules 62 can be separated from the lower storage modules 65 by moving the upper storage modules upward. This allows easy removal of the jammed banknote.

In conventional examples where the upper and lower storage modules are connected, e.g., with hinges, the upper storage modules can be rotated, but cannot be separated from the lower storage modules. To rotate the upper storage modules in a greater range, space needs to be ensured in advance in a certain area around the depositing/dispensing machine, i.e., space to which the rotated upper storage modules move. However, when sufficient space is not ensured in the certain area, the upper storage modules cannot be rotated in a greater range, and the transport path cannot be widely exposed. When the hinges are used to connect the upper and lower storage modules, and an angle of rotation is small, part of the transport path near a hinge axis is hardly exposed. This makes the removal of the jammed banknote difficult, and reduces workability.

In contrast, the above-described configuration in which the upper storage modules 62 and the lower storage modules 65 are separable, the upper storage modules 62 are detached from the lower storage modules 65, and then the upper storage modules 62 can freely be moved. Thus, there is no need to ensure the space in the certain area around the depositing/dispensing machine 1. That is, as long as space is ensured anywhere around the depositing/dispensing machine (e.g., space which allows an operator to stand aside the machine to remove the banknotes), the upper storage modules 62 can be detached, and the banknotes can be removed from the exposed transport path 432. This allows easy removal of the jammed banknote irrespective of the location of the depositing/dispensing machine 1.

In addition, since the upper storage modules 62 can be detached and separated from the lower storage modules 65, the second transport surface 654 of the lower storage modules 65 can widely be exposed. Specifically, once the upper storage modules 62 are detached, the second transport surface 654 of the lower storage modules 65 can be visible from immediately above, and from the left and right of the depositing/dispensing machine 1. This eliminates the limitation on the position of the operator in removing the banknotes, and advantageously improves the workability.

In the above-described configuration, the four upper storage modules 62 aligned in the front-back direction are independent from each other. Thus, the four upper storage modules 62 can separately be detached. Therefore, only the upper storage module 62 corresponding to the position of the jammed banknote can be detached to remove the banknote. This can further improve the workability.

Not only the upper storage modules 62, but the lower storage modules 65 are also independent from each other, and can separately be detached from the tray 61. Thus, with the upper storage module 62 and the lower storage module 65 coupled to each other, the coupled upper and lower storage modules 62 and 65 can be detached together from the tray 61. This is advantageous in removing the jammed banknote, and in easy maintenance of the storage modules. With the upper storage module 62 attached to the lower storage module 65, a locking mechanism which inseparably connects the upper and lower storage modules may be provided. In this case, when the locking mechanism connects the upper storage module 62 and the lower storage module 65, both of the upper storage module 62 and the lower storage module 65 can easily be detached from the tray 61 at the same time. When the locking mechanism releases the connection between the upper storage module 62 and the lower storage module 65, the upper storage module 62 can be detached from the lower storage module 65 to separate the two modules 62, 65 as described above. A similar locking mechanism may be provided between the lower storage module 65 and the tray 61. When the locking mechanism is provided, the flat springs 133 for holding the upper storage modules 62 and the lower storage modules 65 may be omitted.

In this example, the upper surfaces of the lower storage modules 65 constitute the second transport surface of the transport path. However, the second transport surface of the transport path is not always formed by the storage modules. For example, a transport unit having the second transport surface may be provided, and the upper storage modules 62 described above may be arranged on the transport unit.

In this example, the transport path 432 extends in the horizontal direction, and the upper storage modules 62 are moved in a vertical direction perpendicular to the horizontal direction to attach or detach the upper storage modules 62 to or from the body. Specifically, the upper storage modules 62 are attached or detached in the vertical direction. However, the transport path may be formed to extend in the vertical direction, and the storage modules may be attached or detached by moving them in the horizontal direction. That is, the upper storage modules 62 may be attached or detached in the horizontal direction.

The depositing/dispensing machine to which the disclosed technology is applicable is not limited to the depositing/dispensing machine placed in the teller counter. For example, the disclosed technology may be applied to a depositing/dispensing machine for depositing the amount of sales of a shop etc.

The disclosed technology is not limited to the depositing/dispensing machine for depositing/dispensing the banknotes, but may be applied to a depositing machine for depositing the banknotes placed therein, a dispensing machine for dispensing the banknotes contained therein. The disclosed technology is not limited to the banknotes, but can also be applied to various types of paper sheet handling apparatuses for handling checks, tickets, etc.

The present disclosure is not limited to the above-described embodiments, and can be modified in various ways unless otherwise deviated from the spirits and the features of the present invention. The above-described embodiments have been set forth merely for the purposes of preferred examples in nature, and are not intended to limit the scope, applications, and use of the invention. The scope of the present invention is described by the claims, and is not limited by the specification. Deformations and modifications belonging to a range equivalent to the range of the claims are within the scope of the present invention.

What is claimed is:

1. A paper sheet handling apparatus configured to handle sheets, the apparatus comprising:

a transport path which includes a pair of a first transport surface and a second transport surface facing each other, and is configured to transport the paper sheets between the first and second transport surfaces in a transport direction substantially parallel to a horizontal direction;

at least one storage module configured to store the paper sheets transported through the transport path; and a body including the transport path and the storage module, wherein the storage module is attachable and detachable to and from the body by moving the storage module in a predetermined direction substantially perpendicular to the transport direction, a part of an outer surface of the storage module attached to the body forms the first transport surface, and the storage module is separated from the body and the second transport surface in the body when the storage module is detached from the body, and the second transport surface is exposed when the storage module is detached from the body so that the second transport surface in the body is visible from the predetermined direction.

2. The paper sheet handling apparatus of claim 1, wherein the storage module includes at least a first storage module and a second storage module, the first storage module and the second storage module are attached to the body to be adjacent to each other in such a manner that the first storage module is located outward with respect to the second storage module in the predetermined direction, a part of an outer surface of the first storage module forms the first transport surface, a part of an outer surface of the second storage module forms the second transport surface, the first storage module is attachable and detachable to and from the body, and the second transport surface formed by the second storage module is exposed to be visible when the first storage module is detached from the body.

3. The paper sheet handling apparatus of claim 2, wherein the first and second storage modules are able to be coupled to each other, and the first and second storage modules coupled to each other are detachable together from the body.

4. A paper sheet handling apparatus configured to handle sheets, the apparatus comprising:

a transport path which includes a pair of a first transport surface and a second transport surface facing each other, and is configured to transport the paper sheets between the first and second transport surfaces;

at least one storage module configured to store the paper sheets transported through the transport path; and a body including the transport path and the storage module, wherein the storage module is attachable and detachable to and from the body by moving the storage module in a predetermined direction, a part of an outer surface of the storage module attached to the body forms the first transport surface, the storage module is separated from the body and the second transport surface in the body when the storage module is detached from the body, and the second transport surface is exposed when the storage module is detached from the body so that the second transport surface in the body is visible from the predetermined direction, the storage module includes at least first and second storage modules, and the first and second storage modules are adjacent to each other and are attached to the body so that the first storage module is an upper storage module and the second storage module is a lower storage module, a part of an outer surface of the first storage module forms the first transport surface, and a part of an outer surface of the second storage module forms the second transport surface, the first storage module is attachable and detachable to and from the second storage module, the first storage module includes one of a positioning pin or a notch, and the second storage module includes the other of the positioning pin or the notch, the notch extends in a vertical direction, and the positioning pin is inserted in the notch, and the positioning pin moves inside the notch when the first storage module is moved toward an upper direction relative to the second storage module, and the second transport surface is exposed when the positioning pin is separated from the notch and the first storage module is separated from the second storage module in the body so that the second transport surface is visible from the predetermined direction.

* * * * *